United States Patent [19]

Karasawa

[11] Patent Number: 4,474,372

[45] Date of Patent: Oct. 2, 1984

[54] OBSTACLE DRIVING GAME UTILIZING REFLECTED IMAGE

[75] Inventor: Hideyasu Karasawa, Tokyo, Japan

[73] Assignee: Tomy Kogyo Company, Inc., Japan

[21] Appl. No.: 466,670

[22] Filed: Feb. 15, 1983

[30] Foreign Application Priority Data

Feb. 16, 1982 [JP] Japan ..... 57-23070

[51] Int. Cl.[3] ..... A63F 9/14

[52] U.S. Cl. ..... 273/1 GA; 434/63

[58] Field of Search ..... 273/1 GA, 1 GC, 1 E; 434/63, 32

[56] References Cited

U.S. PATENT DOCUMENTS

| | | | |
|---|---|---|---|
| 3,635,477 | 1/1972 | Ochi | 273/1 GA X |
| 3,707,781 | 1/1973 | Brown | 273/1 GA X |
| 3,734,497 | 5/1973 | Brown | 273/1 GA |
| 4,123,050 | 10/1978 | Casado | 273/1 GA |
| 4,174,833 | 11/1979 | Hennig et al. | 273/1 GA |
| 4,231,571 | 11/1980 | Watanabe | 273/1 GA |
| 4,241,925 | 12/1980 | Watanabe . | |
| 4,326,721 | 4/1982 | Minami et al. . | |

*Primary Examiner*—Paul E. Shapiro

*Attorney, Agent, or Firm*—K. H. Boswell; Edward D. O'Brian

[57] ABSTRACT

An obstacle avoidance driving type toy has a housing with a motor located in the housing. The output of the motor is fed to a switch member which, in turn, conducts the output to either a first transfer mechanism or a second transfer mechanism. The first transfer mechanism transfers output of the motor to a moving member which includes an encounter sensor located on it. An object, under the control of the operator of the toy, is maneuvered with respect to the movement of the moving member, and if the maneuvering of the obstacle is not coordinated with the movement of the moving member, the obstacle will encounter the encounter sensor. When so encountered, a signal from the encounter sensor is fed to the switch member, which switches the output of the motor to the second transfer mechanism. This activates an indicating mechanism to indicate the encounter between the obstacle and the moving member, and additionally, sets a reset mechanism which then resets the switch member such that the output of the motor is once again transferred to the moving member.

34 Claims, 23 Drawing Figures

Fig. 1
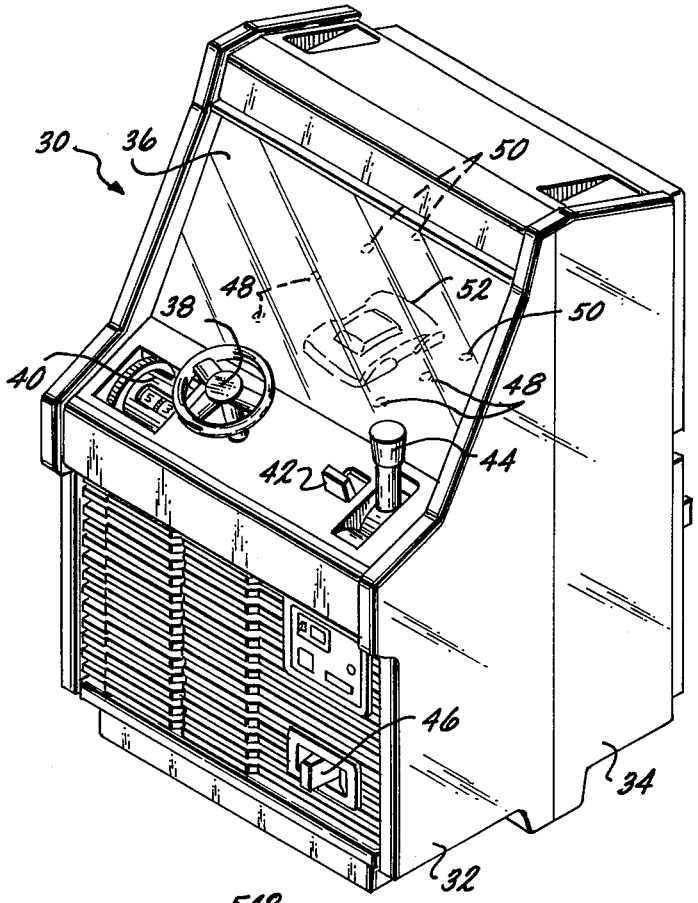
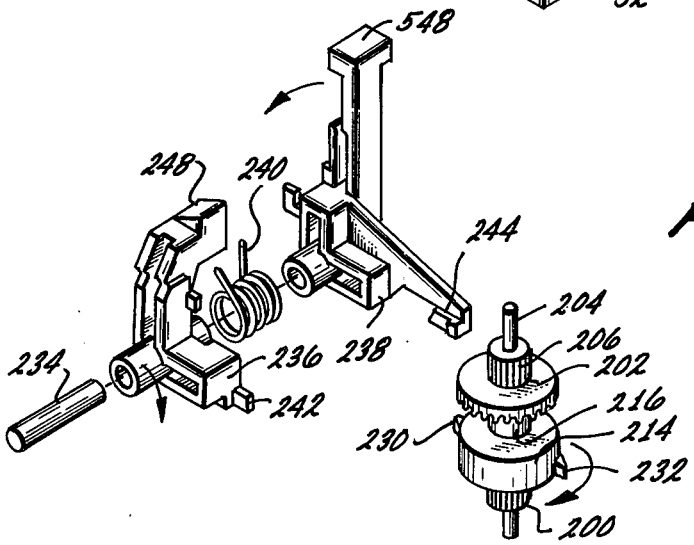
Fig. 9

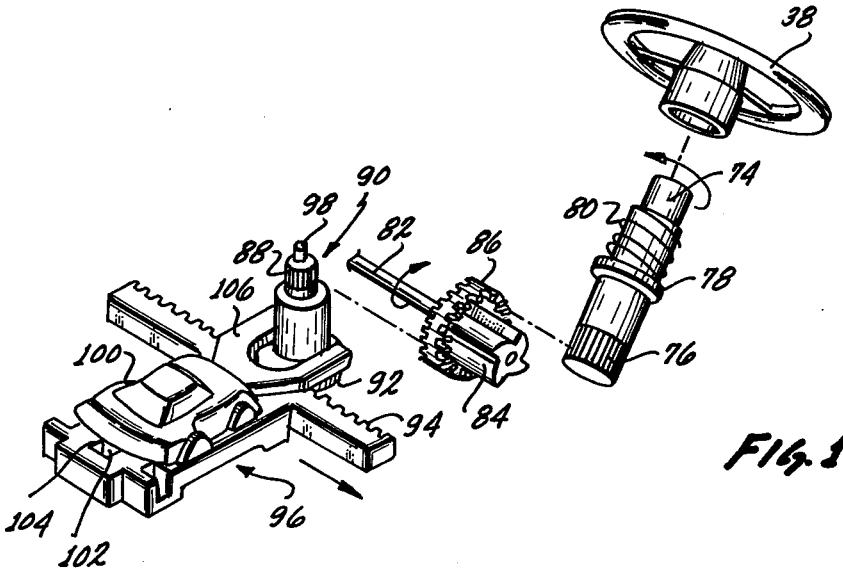
FIG. 13
FIG. 14
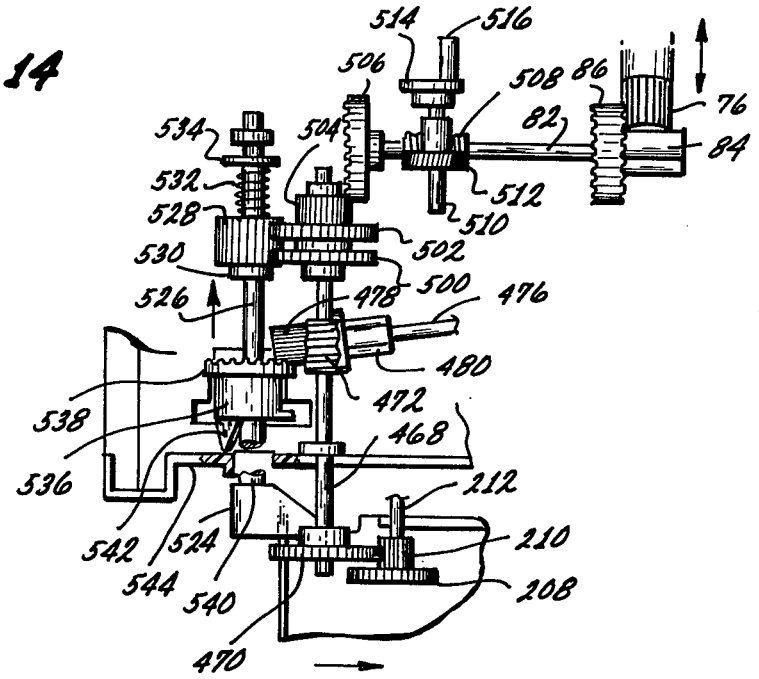

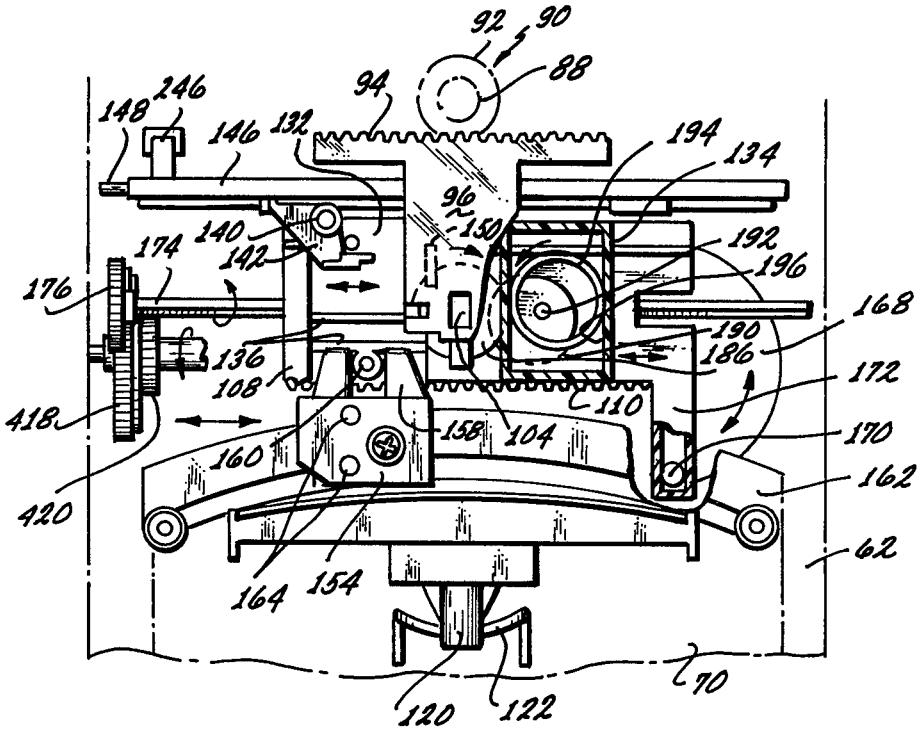
FIG. 19
FIG. 20
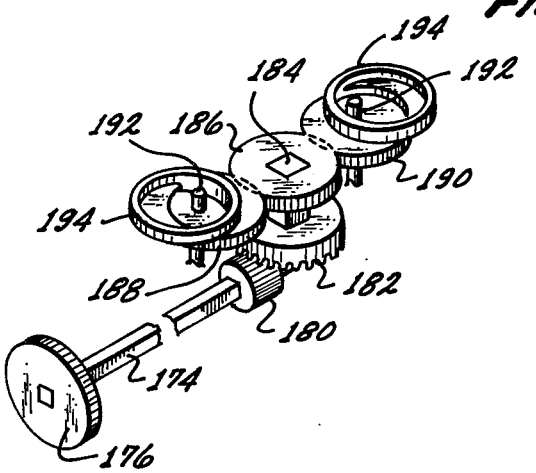

OBSTACLE DRIVING GAME UTILIZING REFLECTED IMAGE

BACKGROUND OF THE INVENTION

This invention is directed to toys of the general classification wherein an object is moved with respect to a moving member, and if the movement of the obejct and the moving member is not coordinated, an encounter between the object and the moving member is displayed to the user of the toy. Furthermore, the toy includes a reflective surface through which the object and the moving member are viewed. The reflective surface moves in conjunction with the moving member and modifies the image of the moving member and the object.

A large variety of mechanisms are known which are either classified as toys or as driver training aids, which utilize moving belts, moving discs and the like, which carry on them images of cars, airplanes and the like, through which the operator of the toy or training aid attempts to negotiate a vehicle or the like under the control of the operator of the toy or training aid.

These known devices have a range of complexity ranging from devices wherein actual physical implements are located on a moving disk and become lodged against, or abutt up next to, the object which the operator is controlling, to other devices wherein complex arrays of electrical switches are utilized to sense the encounter between the object controlled by the operator and the background objects carried on the disks, drums, film strip or the like.

The use of disks, drums or the like having simulated moving objects which are painted, added as decals or the like, is limited with respect to the type of motion which can be created. Disks and drums, by their very nature, are circular, and thus have a finite surface area in which to create an obstacle pathway, such as a road way or the like, incorporating objects which act as obstacles. Film strips can only have a finite length in order to be practical, and as such, they are also somewhat limited as to the pathway produced for the operator to traverse.

Additionally, in order to detect a "crash", or other interaction between the objects under the operator's control, and the background objects on the disk, drum, film strip or the like, something must be included on the disk, drum, film strip or the like which can sense a "crash", or encounter. This leads to undue complexity, which in turn increases manufacturing costs.

In the toy arts, manufacturing costs can be of paramount importance. While an extremely sophisticated mechanism could be developed for a flight simulator for training airline pilots, such a mechanism is, of course, totally unusable in a toy because of its complexity and its cost. Therefore, in the toy arts, the realism of these devices are sometimes compromised in view of the economics of manufacture.

BRIEF DESCRIPTION OF THE INVENTION

In view of the above, it is a broad object of this invention to provide a toy of the type wherein an object is driven against a background which simulates the actual use of a moving vehicle. It is a further object to provide such a toy which allows for complex movement of the background in order to increase the "challenge" and "play value" of the toy. Further, it is an additional object of this game to provide a toy which, because of its engineering and design principles is economically manufactured and thus is economically available to the consumer public.

These and other objects, as will become evident from the remainder of this specification, are achieved in a toy which comprises: a housing, a mechanical output means located in said housing and capable of producing a mechanical output; a switching means located in said housing in operative association with said mechanical output means, said switching means receiving said mechanical output from said mechanical output means and capable of further transmitting said mechanical output so received; a first output transferring means and a second output transferring means each operatively associated with said switching means, said switching means in a first switching mode capable of transferring said mechanical output to said first output transferring means and in a second switching mode transferring said mechanical output to said second output transferring means, each of said first and said second output transferring means capable of further transferring said mechanical output so received; a movable means located in said housing in operative association with said first output transferring means and capable of receiving said mechanical output from said first output transferring means and in response to receipt of said mechanical output moving in said housing; an object means located in said housing; an encounter sensing means located in said housing with at least a portion of said encounter sensing means located on said movable means and movable in conjunction with movement of said movable means, said encounter sensing means capable of sensing if said movable means encounters said object means as said movable means moves in said housing and when said encounter means senses an encounter between said movable means and said object means said encounter sensing means activating said switching means to switch from said first switching mode to said second switching mode such that said switching means ceases transferring said mechanical output to said first output transferring means and transfers said mechanical output to said second output transferring means; an encounter indicating means located in said housing in operative association with said second output transferring means so as to receive said mechanical output from said second output transferring means and upon receipt of said mechanical output producing a discernible indication output; switching means reset means located in said housing in operative association with said second output transferring means, said reset means in response to said switching means being in said second switching mode capable of actuating said switching means to switch said switching means from said second switching mode to said first switching mode to cease transferring said mechanical output to said second output transferring means and transfers said mechanical output to said first output transferring means.

The above described toy can be further augmented by making the object means movable in the housing under the direction of an object moving means. Additionally, a timing means can be operatively associated with the mechanical output means to control the length of time of operation of the mechanical output means. A registering means can be associated with the first output transferring means with the registering means capable of recording a parameter associated with the elapsed mechanical output transferred by the first output transferring means.

Additionally, a motion complexing means can be interpositioned between the movable means and the first output transferring means. The motion complexing means would be capable of modifying the mechanical output transferred from the first output transferring means to the movable means with the modification of the mechanical output preferredly being modification of either the speed of movement or the direction of movement, or both.

Additionally, the above objects are provided in a toy which comprises: a housing; a motor located in said housing; a motion transfer means operatively connected to said motor and capable of receiving motion from said motor and transferring said motion; a carriage means movably mounted in said housing in operative association with said motion transfer means and movable linearly back and forth along an axis in response to motion received from said motion transfer means; a control means located in said housing, at least a portion of said control means being mounted on said carriage means with said portion being movable in conjunction with said movement of said carriage means, said control means operatively associated with both said motion transfer means and said carriage means; an object means movably mounted in said housing in association with said carriage means; object moving means mounted on said housing and having a portion exposed out of said housing in a position so as to be capable of being manipulated by an operator of said toy, said object moving means operatively associated with said object means and capable of moving said object linearly back and forth along an axis which is parallel with the axis of movement of said carriage means; said object means capable of interacting with said portion of said control means located on said carriage means if the movement of said object means under the influence of said manipulation by said operator is not coordinated with the movement of said carriage means in response to motion received by said carriage means from said motion transfer means and in response to said interaction of said object means with said control means said control means disrupting said association of said motion transfer means and said carriage means stopping said movement of said carriage means.

In the toy of the preceding paragraph, a detection means can be associated with the control means with the detection means capable of detecting the disruption of the association of the carriage means and the motion transfer means, and in response to said detection, the control means would initiate reinstatement of the association of the carriage means and the motion transfer means. The detection means can include an indicator means capable of indicating the disruption of the association between the carriage means and the motion transfer means. A reset means can be formed as a part of the control means with the reset means operatively associated with the detection means. The reset means is activated upon the initiation of the disruption between the carriage means and the motion transfer means, and after the expiration of a predetermined time period, the reset means would initiate reinstatement of this association.

A visual effects modifying means can be associated with the carriage means and the object means with at least a portion of one of the carriage means or the object means being indirectly visible to the operator of the toy after this portion has been acted upon by the visual effects modifying means. The visual effects modifying means can be movably mounted in the housing in association with the carriage means so as to move in conjunction with the carriage means. Movement of the visual effects modifying means would increase the complexity of the visual effect observed by the operator of the toy.

Preferredly, this visual effects modifying means would comprise a mirror capable of reflecting an image back to the operator of the toy with the mirror preferredly of a convex shape. Preferredly, at least one of the carriage means or the object means, or both, could include an illuminating means capable of illuminating at least a section of them.

The control means can include a sensing means which, in turn, can include a first and second trip means located on the carriage means. The object means would be capable of interacting with the trip means in response to lack of coordination between the movement of the carriage means and the object means.

Preferredly, the motor would produce a rotary motion as its output, with the motion propagated by the motion transfer means through a motion propagation means and a motion translation means. The motion propagation means would propagate rotary motion of the motor to the motion translation means with the motion translation means translating this rotary motion to linear motion to move the carriage back and fourth in a linear manner.

Preferredly, the control means would include a switch means operatively associated with the sensing means and with the propagation means, with the switch means capable of disrupting the propagation of motion by the motion propagation means in response to interaction of the object with one of the trip means. The reset means would be preferredly associated with the switch means with the switch means responding to the reset means to re-establish propagation of motion by the motion propagation means.

The toy can further include a secondary carriage means located on the carriage means in association with a second translation means. The second translation means would be capable of moving the secondary carriage means on the carriage means in response to rotary motion ultimately received from the motor.

BRIEF DESCRIPTION OF THE DRAWINGS

This invention will be better understood when taken in conjunction with the drawings wherein:

FIG. 1 shows an oblique view of the outside of a toy constructed as per this invention;

FIG. 9 is an exploded view of certain components which are located in the upper right hand portion of FIG. 4;

FIG. 13 is an exploded view of certain components, one of which is seen in FIG. 1, and the remainder of which would be hidden from view directly behind the components seen in FIG. 1;

FIG. 14 is a side elevational view in partial section of certain of the components located near the left hand side of FIG. 12 as well as a portion of the housing seen in the upper left hand corner of FIG. 3;

FIG. 19 is a view similar to FIG. 18 with certain components removed for clarity of the underlying components;

FIG. 20 is an oblique view of certain of the components seen in FIG. 19;

Figure 2:
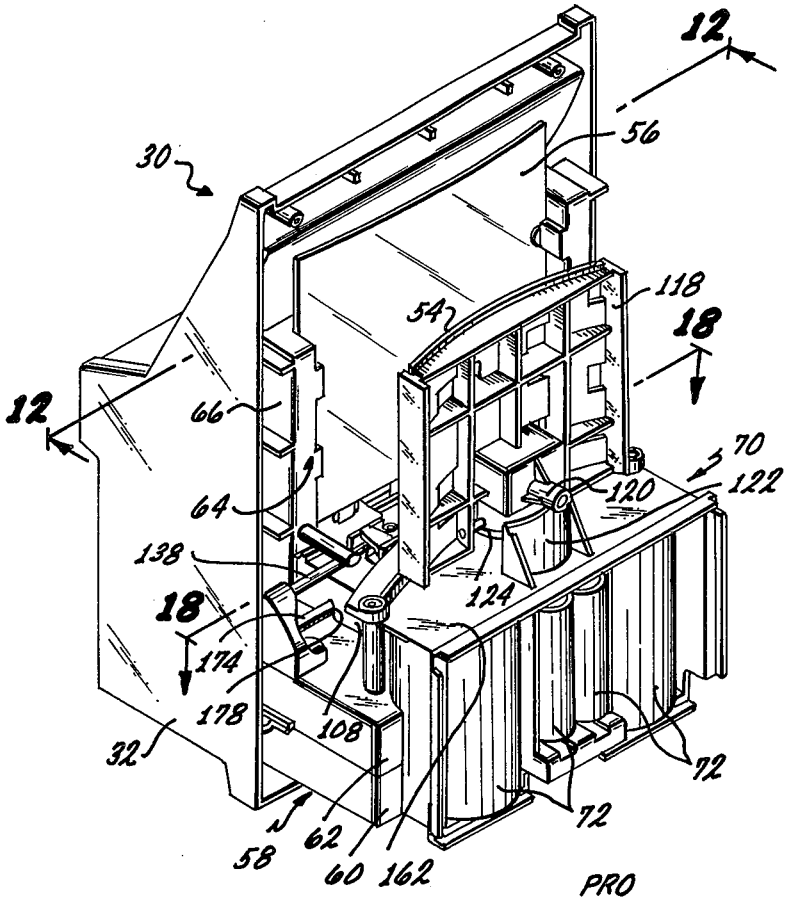
FIG. 2 is an oblique view of the back side of the toy of FIG. 1, with an outer housing removed to show details of components positioned within the interior of the toy.

The invention described in this specification and illustrated in the drawings utilizes certain principles and/or concepts as are set forth in the claims appended to this specification. Those skilled in the toy arts will realize that these principles and/or concepts are capable of being expressed in a variety of illustrative embodiments which could differ from the illistrative embodiment utilized herein. For this reason, this invention is to be construed only in light of the claims, and is not to be construed as being limited to the exact illustrative embodiment depicted.

DETAILED DESCRIPTION OF THE INVENTION

In FIG. 1, a toy 30 utilizing the principles of this invention is illustrated. The toy 30 includes a front housing 32 mated to a rear housing 34. The front housing 32 contains a window 36 allowing for viewing into the interior of the toy 30. Below the window 36 is a steering wheel 38, a skill indicator 40, an off/on button 42, a shifting lever 44 and a skill shift lever 46.

Viewable through the window 36 is a road, identified by two sets of images, the first collectively identified by the numeral 48, and the second collectively identified by the numeral 50. To the user of the toy 30, the road images 48 and 50 appear the same; however, as will be evident from further discussion in this specification, the images 48 are viewed directly by the user of the toy, whereas the images 50 are reflections of the images 48. Centered between the road images 48 and 50 is a vehicle image 52.

The toy works as follows. The skill indicator 40 is reset to zero, and the skill shift lever is moved to one of two positions, the first requiring a lesser skill in operating the toy 30 and the second requiring an advanced skill. Then the off/on button 42 is switched to the "on" position. This activates the toy such that the road images 48 and 50 light up, as well as the vehicle image 52. The vehicle image 52 is driven through an imaginary road which is created by the road images 48 and 50 by utilizing the steering wheel 38. The vehicle image 52 can be made to appear to drive faster or slower along the imaginary road created by the road images 48 and 50 by shifting speeds utilizing the shifting lever 44.

The shifting lever 44 has a neutral position wherein the vehicle image 52 does not move with respect to the road images 48 and 50, a slow speed, an intermediate speed and a fast speed with respect to the movement of the vehicle image 52 and the road images 48 and 50.

As the toy operates, the road images 48 and 50 sweep back and forth across the horizon, giving the impression of a road which is curving as the vehicle image 52 negotiated along it. The operator of the toy 30 utilizes the steering wheel 38 in attempts to maintain his vehicle image 52 within the left and right side road images 48 and 50 as they sweep left and right across the window 36. As long as the vehicle image 52 is maintained on the imaginary road created between the left and right side road images 48 and 50, the vehicle image 52 continues to travel down this imaginary road and points are accumulated on the skill indicator 40. The operator of the toy 30 can make the vehicle image 52 seemingly go faster or slower along the imaginary road by shifting the shifting lever 44 between its positions.

If the vehicle image 52 trespasses too far to either the left or the right and contacts the road images 48 and 50, movement of the vehicle image 52 with respect to the imaginary road created by the road images 48 and 50 immediately ceases, the steering wheel 38 starts vibrating, and an image appears in the window 36 above the vehicle image 52, indicating that the vehicle image 52 has crashed into the side of the imaginary road created by the road images 48 and 50. These indications continue for a set period of time, after which the toy 30 resets itself as hereinafter explained, and once again the imaginary road created by the road images 48 and 50 move and the operator of the toy 30 continues to manipulate the vehicle image 52 down this imaginary road under the control of the steering wheel 38.

After a predetermined time period elapses, the toy 30 automatically stops and the operator of the same can judge his skill by seeing how many points were accumulated on the skill indicator 40 during this time period. More points will be accumulatable by having the shifting lever 44 in the fastest position than if the shifting lever 44 is in the intermediate or slow positions, the intermediate position representing a medium level of point accumulation between the fast and slow positions.

The complexity of the movement of the imaginary road created by the road images 48 and 50 will increase by shifting the skill shift lever 46 to the higher skill position. When so positioned, this causes the road images 48 and 50 to move in a complex manner, requiring more skill in maintaining the vehicle image 52 centered between them.

Referring now to FIG. 2, mounted in the toy 30 is a convex mirror 54, which is positioned to reflect an image of the road images 48. There are two road images 48 on both the left and right hand sides, and when these are reflected, a multiplicity of images are then viewable from the front of the toy 30 through the window 36. Positioned in front of the mirror 54 is a partially silvered mirror 56, which reflects an image creating the vehicle image 52 in the window 36. It also reflects an image of a further mechanism which indicates a "crash" wherein the vehicle image 52 strays on to the road images 48 or 50 on either the left or right hand side as noted above. The partially silvered mirror 56 allows for transmission of the direct images of the road images 48 as well as reflected road images 50 through it. The image of the component hereinafter numbered and identified which creates the vehicle image 52 moves back and forth in front of the partially silvered mirror 56 and this image is superimposed upon the road images 48 and 50 when viewed through the window 36.

Still referring to FIG. 2, located inside the toy 30 is a lower component housing 58 having a bottom section 60 and a top section 62. These can best be seen in FIG. 3, wherein the lower component housing 58 is isolated from the remainder of the interior components of the toy 30.

Figure 12:
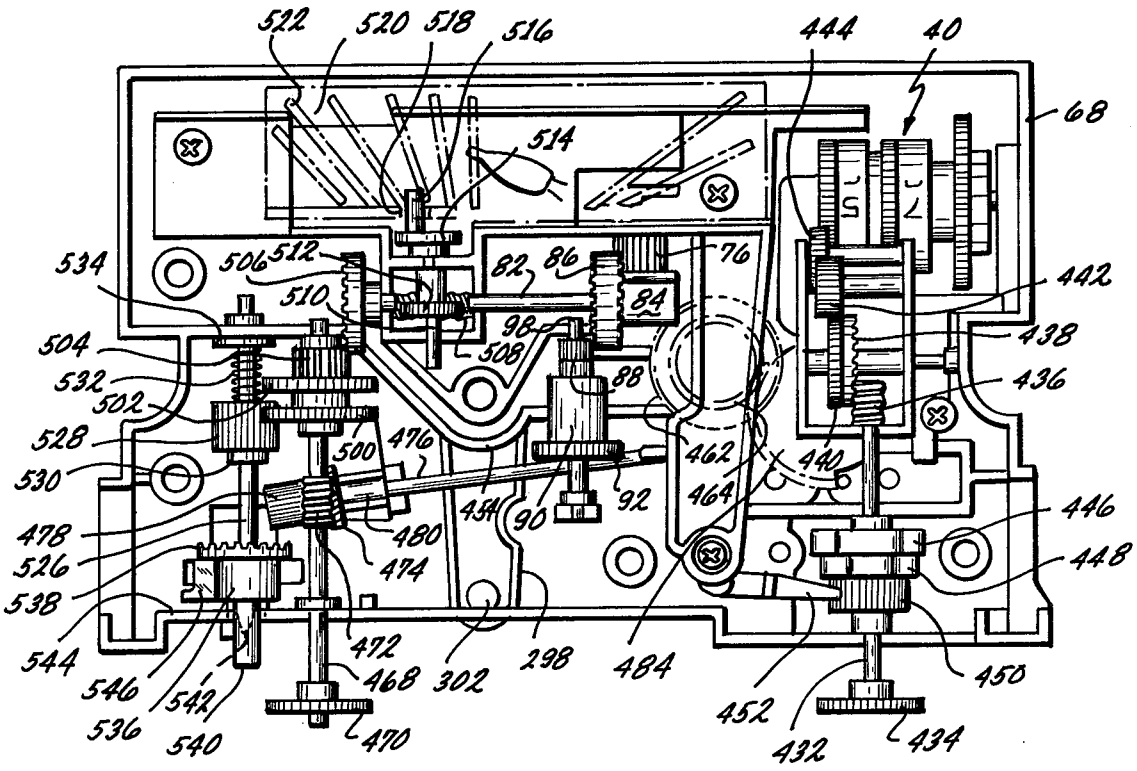
FIG. 12 is an elevational view about the line 12—12 of FIG. 2.

Positioned above the lower component housing 58 is an upper component housing 64. For the most part the upper component housing 64 fits within the front housing 32. The upper component housing 64 has a rear plate 66 and a front plate 68 which is seen in FIG. 12. The rear plate 66 serves as the holder for the one way mirror 56.

Positioned to the rear of the lower component housing 58 and extending above it, is a rear component housing 70. The housing 70 is positioned within the rear housing 34 when the front and rear housings 32 and 34, respectively, of the toy 30 are assembled. The convex mirror 54 is movably mounted on top of the rear component housing 70 such that it can oscillate back and forth to the right and left.

The rear component housing 70 serves to hold a plurality of batteries, collectively identified by the numeral 72, which supply electrical power to drive a motor, hereinafter identified and numbered, and certain lights and light emitting diodes hereinafter identified and numbered. Access to the batteries 72 is through a door, not seen nor numbered, in the rear housing 34.

In reference now to FIGS. 1, 12 and 13, the mechanism which controls the movement of the vehicle image 52 will be described. As noted above, FIG. 12 showed the upper component housing 64. This fits within the front housing 32 of the toy 30 in the upper portion of the front housing 32. The steering wheel 38 mounts to a shaft 74 which projects through the front housing 32 down into the upper component housing 64. The steering wheel 38 is fixed to the shaft 74 such that the shaft 74 rotates in response to rotation of the steering wheel 38. The shaft 74 includes gear teeth 76 formed on its lower end. Additionally, it includes a flange 78 located approximately mid-section, against which a spring 80 abutts. The shaft 74 fits within the front plates 68 of the upper component housing 64. The spring 80 biases the shaft 74 downward.

The lower end of the shaft 74 rides against a shaft 82 which includes four cam surfaces, collectively identified by the numeral 84, against which abutts the lower end of the shaft 74. A gear 86 having teeth on both of its sides is formed on the shaft 82. The gear teeth 76 on the shaft 74 mate with one set of the gear teeth on the gear 86 such that rotation of the shaft 74 is transferred to the shaft 82.

The other gear teeth on the gear 86 mate with a pinion 88 formed on the upper end of a cylindrical member 90. On the lower end of cylindrical member 90 is a larger pinion 92 which meshes with gear rack 94. The gear rack 94 is formed as a portion of object member 96. The member 90 is mounted on an axle 98. Both the pinion 88 and the pinion 92 are fixed to the axle 98 such that rotation of the pinion 88 results in corresponding rotation of the pinion 92. As a result of this, rotation of the steering wheel 38 is ultimately transferred to the pinion 92 and rotation of the pinion 92 moves the gear rack 94 linearly back and forth.

The shafts 74 and 82, the axle 98 and other axles and shafts, as hereinafter explained, are appropriately mounted in bearing surfaces formed in either the lower component housing 58, the upper component housing 64, or the rear component housing 70. For brevity of this specification, these individual bearing surfaces will not be identified or numbered, it being sufficient to note that, where appropriate, any axle, shaft or other like component is appropriately suspended in one of the above referred to housings by locating the same in appropriate bearing surfaces and the like. Additionally, other components, such as the object member 96 appropriately slide, either linearly or arcuately on other surfaces of the above referred to component housings. Again, for brevity of this specification, the guides on which these components slide will not be separately identified or numbered.

A vehicle 100 made of an opaque material has a light, hereinafter numbered and identified, located inside of it. As will be later discussed, when the electrical circuit of the toy 30 is activated by turning on the off/on button 42, this light illuminates the inside of the vehicle 100 such that the image is carried to the one way mirror 56 and reflects back to the window 36 as the vehicle image 52. The vehicle 100 includes a small downwardly projecting tab 102 which fits into an opening 104 formed on the object member 96. This allows pivoting of the vehicle 100 with respect to the object member 96. At the other end of the vehicle, opposite the tab, is a yoke 106. The yoke 106 loosely fits around the member 90. As the gear rack 94 moves back and forth with respect to the member 90 in response to rotation of the pinion 92, the yoke 106 pivots about the member 90 and the vehicle 100 pivots about its tab 102 with respect to the object member 96, which, of course, is moving in response to movement of the gear rack 94, which is formed as a part of it. This maintains the orientation of the vehicle 100 toward the member 90. The vehicle image 52 seen reflected from the vehicle 100 therefore always points toward the center of the window 36 as this image 52 is moved back and forth across the window 36.

Figure 3:
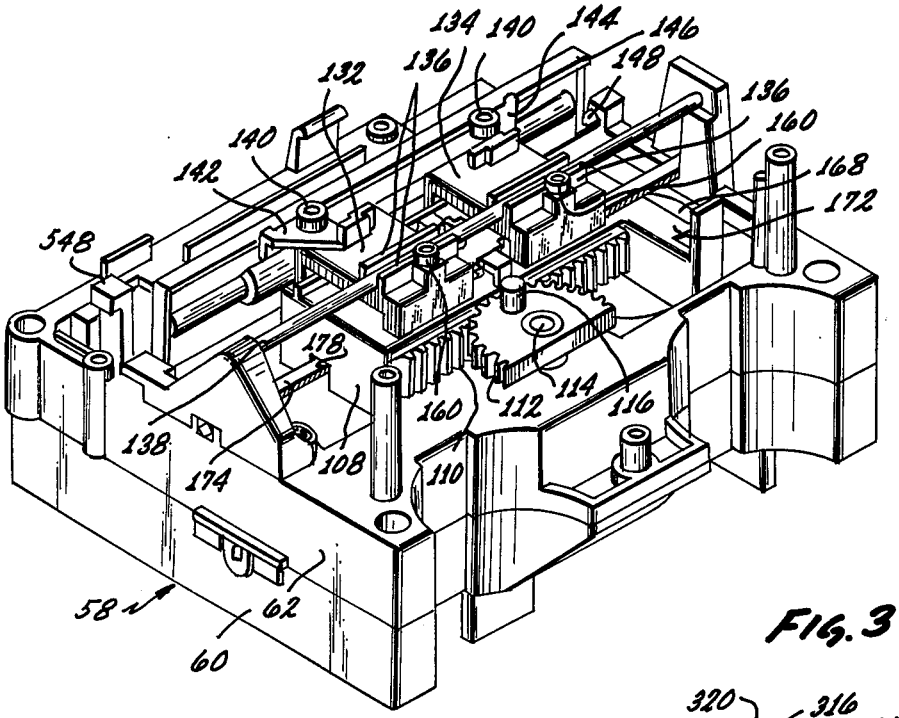
FIG. 3 is an oblique view of the back side of certain of the internal components of the toy of FIG. 2 which are generally located in the lower front portion of the toy.
Figure 18:
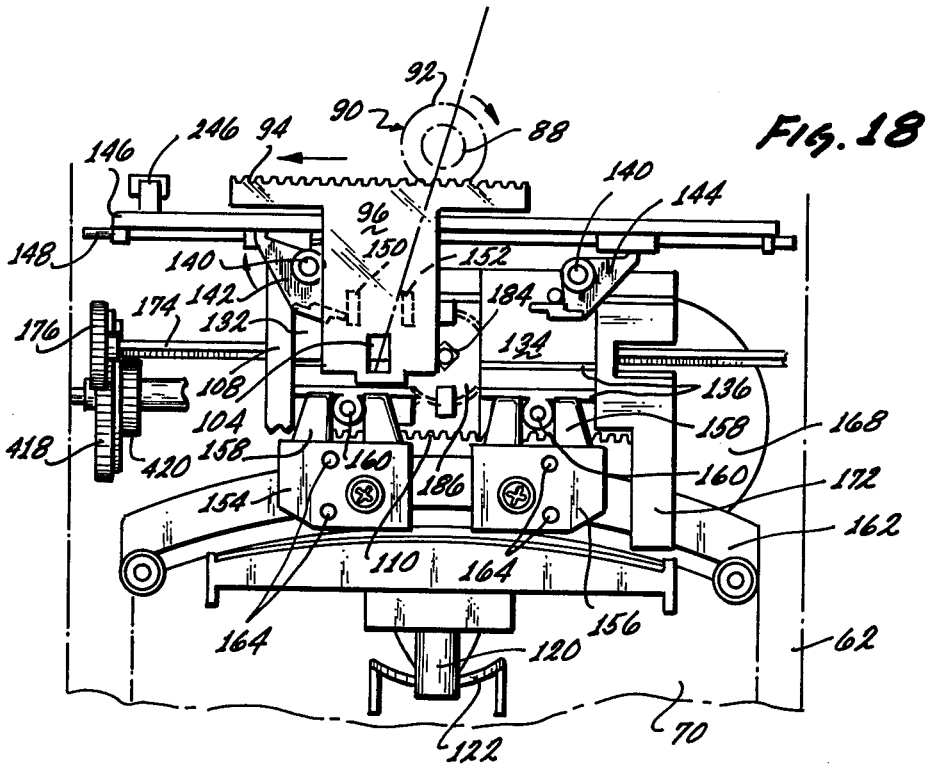
FIG. 18 is a plan view about the line 18-18 of FIG. 2.

Referring now to FIGS. 3, 18 and 19, a carriage 108 rests on the top 62 of the lower component housing 58.

The carriage 108 is free to slide back and forth across the top 62. It is moved back and forth linearly across the top 62, as hereinafter described. It is sufficient to note at this point that it can move back and forth to the left and right as viewed, for example, in FIG. 18. As is evident from FIGS. 18 and 19, the carriage 108 is located below the object member 96.

The carriage 108 includes a gear rack 110, formed on its back side. A sector gear 112 is mounted to rotate about a boss 114 formed on top 62. As the carriage 108 moves linearly back and forth, the sector gear 112 rotates about the boss 114, which in turn, moves a crank pin 116, which is formed on the top of and projects upwardly from the sector 112.

Figure 21:
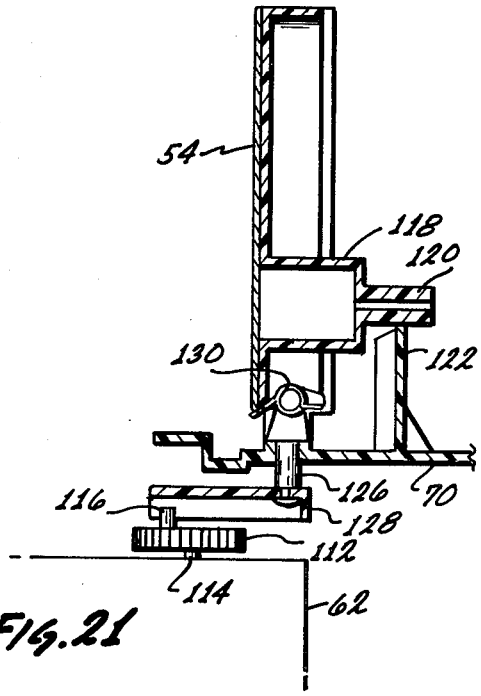
FIG. 21 is a side elevational view in section of one of the components seen in FIG. 2.

Referring now to FIG. 21 for a moment, the mirror 54 is mounted on a mirror housing 118. The mirror housing 118 includes a rearwardly projecting boss 120, which rests on the top of a baffle 112 formed as a part of rear component housing 70. The mirror housing 118 is mounted about an axle 124 which attaches in turn to a boss 126 which projects through the rear component housing 70 and culminates in an arm 128. The arm 128 engages the crank pin 116.

A small hairpin spring 130 biases the mirror housing 118 counterclockwise as viewed in FIG. 21 such that the boss 120 rests against the top of the baffle 122. As the sector gear 112 rotates with respect to movement of the carriage 108, movement of the sector gear 112 is transferred via the crank pin 116 to the arm 128. This, in turn, rotates the boss 126 with respect to the rear component housing 70 which also results in rotation of the mirror housing 118 and the mirror 54 attached thereto. The top of the baffle 122 is curved, with its ends being lower than its center such that as the boss 120 moves across its curved surface, the mirror 54 is tilted as it sweeps from side to side in conjunction with movement of the carriage 108. When the mirror 54 is centered, it is almost upright as seen in FIG. 21; however, when it is turned to either the left or right side, because the ends of the baffle 122 are lower than its middle, the boss 120 descends and tilts the mirror 54 upwardly. This gives a complexity to the visual effect between the road images 48 and 50. When the mirror 54 is tilted to either the right or left, the reflected road images 50 bend away from the direct road images 48 giving an effect of a curved road formed by the road images 48 and 50.

Moving back to FIGS. 3, 18 and 19, the carriage 108 carries sub carriages 132 and 134 on top of it. These sub carriages are capable of moving in a complex manner. First of all, they move in conjunction with movement of the carriage 108. However, additionally, they move with respect to the carriage 108 in a manner as hereinafter explained. It is sufficient to note at this time that, as the carriage 108 moves linearly back and forth, so do the sub carriages 132 and 134. Each of the sub carriages 132 and 134 include two upward projecting baffles collectively identified by the numeral 136 which forms a channel between them. A transverse rod 138 fits between the baffles 136 and maintains the sub carriages 132 and 134 oriented on the carriage 108. The transverse rod 138 is appropriately positioned above the top 62 of the lower component housing 58 by two upstanding projections not separately identified or numbered, projecting upwardly from the top 62.

Each of the sub carriages 132 and 134 carry a boss, collectively identified by the numeral 140, on them. The bosses 140 project upwardly from the sub carriages 132 and 134. A left side trip member 142 fits on the sub carriage 132 and a right side trip member 144 fits on the sub carriage 134 by appropriately fitting over the bosses 140. Each of the trip members 142 and 144 are free to rotate about the bosses 140 and thus are free to rotate with respect to the sub carriages 132 and 134 and to the carriage 108.

A plate 146, as seen in FIG. 3, is mounted to top 62 about axles 148 located on its respective ends. This allows the plate 146 to pivot with respect to the lower component housing 64. Normally, the plate 148 abutts against the trip members 142 and 144 with the trip members 142 and 144 in continuous contact with the plate 146 as the carriage 108 moves back and forth behind the plate 146.

The object member 96 includes a left side downwardly projecting trip tab 150 and a right side downwardly projecting trip tab 152 formed as a part thereon.

Figure 8:
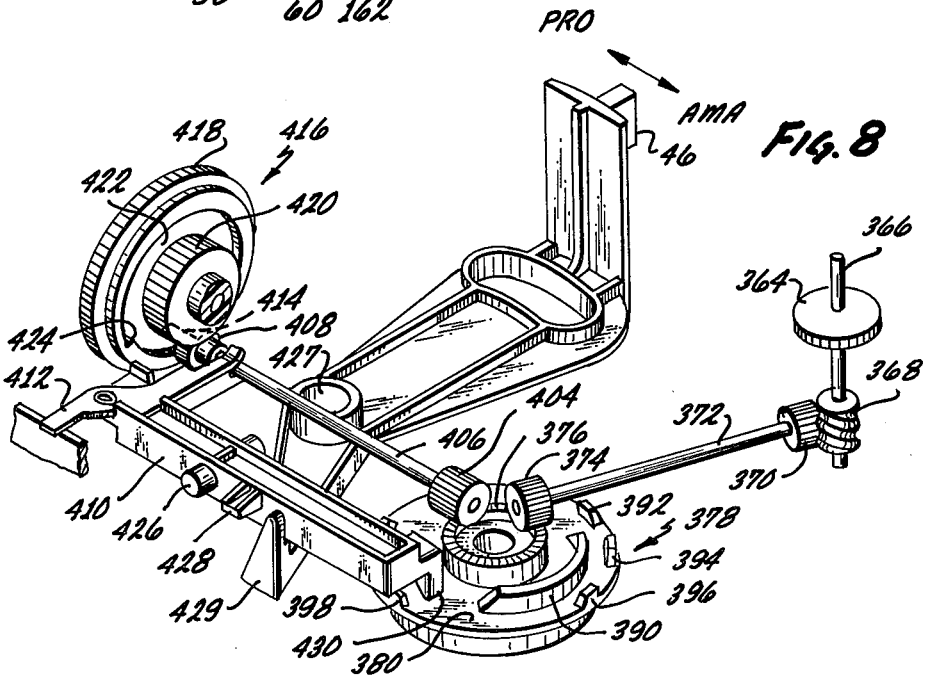
FIG. 8 is an oblique view of certain of the components seen in FIG. 4 which are located generally on the left hand side of FIG. 4.

As noted above, the carriage 108 is caused to move back and forth across the top of upper component housing 64. As it does so, the trip members 142 and 144 also move back and forth. The object member 96 is positioned above the carriage 108 such that its trip tabs 150 and 152 can interact with the trip members 142 and 144, essentially as seen in FIG. 8, wherein the trip tab 150 has abutted against the trip member 142. In utilizing the toy 30, it is an object of the game to steer the vehicle image 52 with respect to the road images 48 and 50, as noted above. In essence, this requires movement of the object member 96 in coordination with movement of the carriage 108. If the movement of these two members is not coordinated with respect to one another, the trip tabs 150 and 152 contact the respective trip members 142 and 144, causing them to pivot about their bosses 140, bringing the trip members 142 or 144 against the plate 146, causing the plate to rotate forwardly about its axles 148. Forward rotation of the plate 146 is communicated to other components, as hereinfter explained. In any event, failure to coordinate the movement of the vehicle image 52 with the road images 48 and 50 results in failure of coordination of movement of the object member 96 with respect to the carriage 108, and interaction of one or the other of the trip tabs 150 or 152 with one or the other of the trip members 142 or 144, respectively. This, in turn, is communicated to the plate 146.

A left and right side following member, 154 and 156, respectively, each have a yoke 158 which loosely engages an upstanding boss, collectively identified by the numeral 160 formed on the sub carriages 132 and 134. Interaction of the yokes 158 with the bosses 160 communicate the movement of the sub carriages 132 and 134 to the following members 154 and 156. A curved track 162 is formed in the rear component housing 70. Each of the following members 154 and 156 engages the curved track 162 and are free to slide along it. Because the yokes 158 are loosely fitted around the bosses 160, as the sub carriages 132 and 134 move linearly back and forth, this movement is transmitted to the following members 154 and 156 allowing them to move arcuately back and forth across the curved track 162.

The left and right side following members 154 and 156 each carry two LED's identified by the numeral 164 which, when energized as hereinafter explained are directly seen as the road images 48. Additionally, an image of the energized LED 164 is reflected by the mirror 54 and seen as a part of the images 50. Further, a second reflection, and even a third reflection are achieved by light reflecting between the mirrors 54 and 56 to form additional road images 50.

The following members 154 and 156 move back and forth along the curved track 162 in response to movement imparted to them by the carriage 108. The LED's 164 move in the same curved pathway as the following members 154 and 156. With respect to the back and forth movement of the carriage 108, the back and forth movement of the LED's 164 causes the imaginary road formed by the road images 48 and 50 to move back and forth across the width of the window 36 and because of the reflection of the LED's 164 in the mirrors 54 and 56, the first, second, third, etc. reflections forming the road images 50 curve away from the road images 48 whenever the LED's 164 approach the sides of the toy 30 as they move back and forth with respect to the movement of the carriage 108, and then straighten out in a line when they are centered on the curved track 62. This gives the impression that the imaginary road formed by the road images 48 and 50 goes straight down the middle of the window 36 but bend towards each side.

Figure 5:
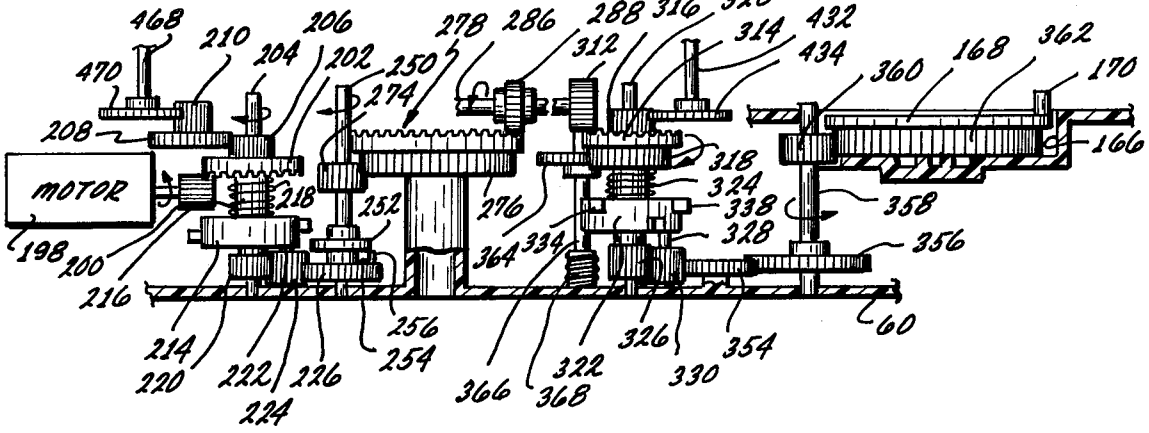
FIG. 5 is an elevational view about the line 5—5 of FIG. 4.

A depression 166 as seen in FIG. 5 is formed in the top 62 of the lower component housing 58. A disk 168 fits into this depression. The disk carries on it a crank pin 170. In reference now to FIG. 19, it can be seen tht the carriage 108 has an arm 172 formed as a part thereof. The arm is hollow on its underneath side and fits over the crank pin 170. The crank pin 170 is free to slide back and forth within the hollow of the arm 172. As hereinafter explained, the disk 168 is caused to rotate both clockwise and counterclockwise. This rotation of the disk 168 is transferred by the crank pin 170 to the arm 172. Movement of the crank pin 170 against the arm 172 results in side to side movement of the carriage 108 along the horizontal axis of FIG. 19. Thus, rotational movement of the disk 168 is transferred to linear movement of the carriage 108 via the interaction of the crank pin 170 with the arm 172.

A square shaft 174 seen in FIGS. 3, 18 and 19, as well as FIG. 20, has a spur gear 176 attached to its left hand side. The spur gear 176 is rotated as hereinafter explained. The shaft 174 traverses across the width of the toy 30 and passes through an opening 178 in the bottom of the carriage 108. The opening 178 goes across the full width of the carriage 108 allowing for extension of the shaft 174 through the carriage 108. The carriage 108 moves back and forth across the shaft 174 with the shaft 174 in one function serving as a guide to maintain linear movement of the carriage 108 as it moves back and forth.

The shaft 174 has a second function in moving the sub carriages 132 and 134 with respect to the carriage 108. A pinion 180 has a square opening in its center allowing the square shaft 174 to pass through it. The pinion 180 is not fixed to the shaft 174 but in fact is free to slide along the length of the shaft 174. However, because of the square shape of the opening in the pinion 180, rotation of the square shaft 174 is transferred to the pinion 180, rotating the pinion 180 in response to rotation of the shaft 174.

The pinion 180 is positioned in the bottom of the carriage 108 such that it is always in contact with a crown gear 182 which is mounted to rotate within the bottom of the carriage 108. The crown gear 182 is mounted to a square shaft 184 which passes through the carriage 108 with a spur gear 186 mounted to the top of shaft 184. The spur gear 186 therefore rotates in response to rotation of the crown gear 182, which in turn is rotated by the pinion 180, which in turn is ultimately rotated by the spur gear 176.

Two spur gears 188 and 190 each mesh with the spur gear 186 and are rotated by the spur gear 186. Each of the spur gears 188 and 190 are formed with a central axle, collectively identified by the numeral 192. The axles 192 are located in appropriate bearings formed in the carriage 108 and are free to rotate in these bearings. Each of the spur gears 188 and 190 include a ring, collectively identified by the numeral 194, which is formed on their upper surface, but which is off center with respect to the axles 192. As such, rotation of one or the other of the spur gears 188 or 190 rotates the rings 194 eccentrically with respect to the axles 192. The spur gears 188 and 190 are positioned with respect to the gear 186 such that the rings 194 are 180° out of phase. As such, as gear 186 rotates, the rings 194 first approach each other and then move away from each other.

As can be seen in FIG. 19, the sub carriage 134 is hollow underneath, with a rectangular wall 196 formed as a portion thereof. The rectangular wall 196 fits over the ring 194. The other sub carriage 132 is formed in an exactly equivalent manner, such that it fits over the ring 194 on the spur gear 188. Rotation of one of the spur gear 188 or 190 is transferred to the ring 194 located thereon and as the ring 104 rotates eccentrically about its axle 192, this rotation is transferred to the sub carriages 132 and 134. The sub carriages, as noted above, each include the rectangular wall 196 formed on their bottom surfaces. Because of their rectangular shape, when the rings 194 rotate, they contact the two side walls, but not the two end walls. Contact with the two side walls in response to the eccentric rotation of the rings 194 move the sub carriages 132 and 134 sideways along the axis of the axle 174. However, since the end walls of the rectangular wall 196 are displaced away from the points of contact of the rings 194, the rings 194 do not contact these and the only movement transferred from the rotational movement of the spur gears 188 and 190 through the rings 194 to the sub carriages 132 and 134 is back and forth movement along the axis of the axle 174. Because of the phase difference between the placement of the rings 194 on the gears 188 and 190, the sub carriages 132 and 134 alternately move away from and then towards each other.

It can be seen that the carriage 108 can be caused to move back and forth along the axis of the axle 174 by interaction of the crank pin 170 with the arm 172. Additionally, the sub carriages 132 and 134 can independently move back and forth away from and toward each other because of the movement imparted to them by the rotation of the axle 174 via the spur gear 176. Since the following members 154 and 156 contact the sub carriages 132 and 134, and do not directly contact the carriage 108, ultimately, the movement of the LED's 164 is governed by the totality of the movement imparted to the following members 154 and 156 by the combination of the movement of the sub carriages 132 and 134 plus the movement of the carriage 108.

It can be seen that the above structure allows for complex movement of the following members 154 and 156. The carriage 108 moves with respect to the surface on which it slides while at the same time, the sub carriages 132 and 134 are moving on the carriage 108. Additionally, since both the carriage 108 and the sub carriages 132 and 134 move linearly in response to rotational movement imparted to them by the eccentrically moving crank pin 170 or the eccentrically moving ring 194, at certain points of the eccentric movement of these members, the carriage 108 and the sub carriages 132 and 134 will stop and reverse direction and thus will oscillate back and forth.

Referring now to FIGS. 4 through 11, the functions of the components located in the lower component housing 58 will be explained. A small electric motor 198 has a pinion 200 located on its output shaft. Pinion 200 engages a crown gear 202 which is fixed to an axle 204. A pinion 206 is formed on the top of the crown gear 202 and rotates in conjunction with it. Pinion 206 meshes with spur gear 208 which has a pinion 210 formed on top of it. The spur gear 208 and pinion 210 rotate about an axle 212 which is fixed to the top 62 of the lower component housing 58. The pinion 210 serves as a rotary output to certain components located in the upper component housing 64 as hereinafter discussed.

Displaced downwardly from the crown gear 202 is a drum 214. The drum 214 has an upward extension 216 around which fits a spring 218. The spring 218 pushes down against the bottom of the crown gear 202 and against the top of the drum 214. The spring 218, however, can slip with respect to each of these with very little force. There is some frictional engagement, however, between spring 218 and the drum 214 and the crown gear 202, tending to impart rotation of the crown gear 202 to the drum 214.

Located beneath the drum 214 is pinion 220. The pinion 220 is fixed to the axle 204 and rotates in conjunction with the axle 204 and the crown gear 202. The spring 218 biases the drum 214 down against the top of the pinion 220 and there is, again, a small amount of frictional engagement between the bottom of the drum 214 and the pinion 220, which further contributes to imparting a small degree of rotational momentum to the drum 214 with regard to rotation of those components fixedly attached to the axle 204.

Figure 10:
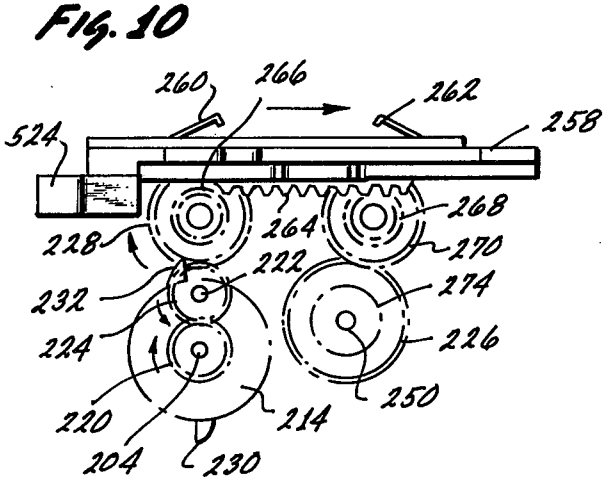
FIG. 10 is a plan view of other components located in the upper left hand portion of FIG. 4.

The drum 214 carries a small axle 222 on its underneath surface. A pinion 224 is mounted on the axle 222. The pinion 224 meshes with the pinion 220. The pinion 224 is positionable in two positions such that it can engage with either spur gear 226 or spur gear 228. Engagement of pinion 224 with spur gear 226 is shown in FIG. 4, while engagement of pinion 224 with spur gear 228 is shown in FIG. 10.

The drum 214 carries two detent teeth, detent tooth 230 and detent tooth 232 on its outer perimeter. The interaction of these detent teeth 230 and 232 with two retaining mechanisms governs whether pinion 224 will be engaged with spur gear 226 or whether it will be engaged with spur gear 228.

Figure 4:
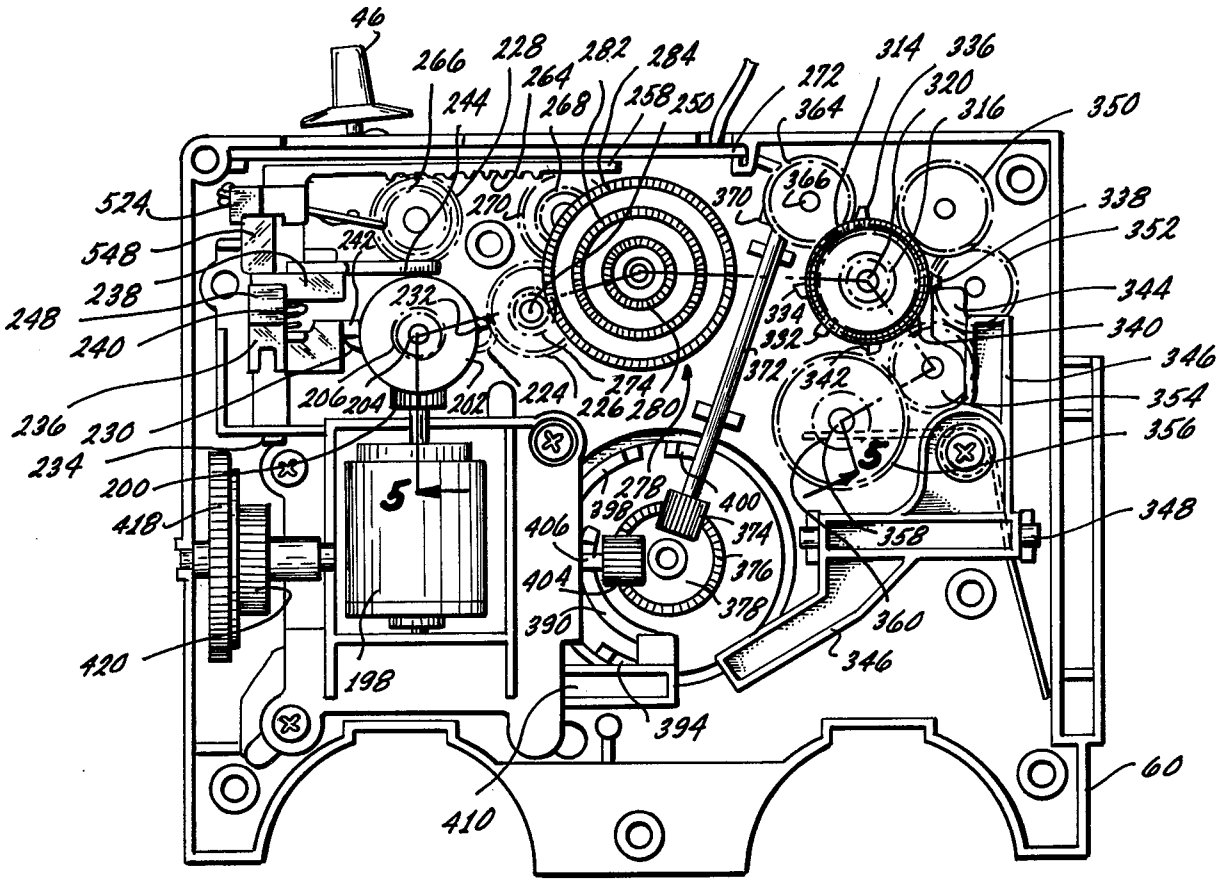
FIG. 4 is a top plan view of certain of the components located in the bottommost portion of FIG. 3 with the upper components and housings removed to better illustarte these components located in the bottommost portion.

Referring now specifically to FIGS. 4 and 9, a short axle 234 is mounted in the left upper hand corner of the bottom section 60 of lower component housing 58. Mounted on axle 234 and pivotable on it is a first positioning lever 236 and a second positioning lever 238. A spring 240 is mounted about axle 234 between the positioning levers 236 and 238 and contacts both of these members. The spring 240 biases the positioning lever 236 counterclockwise as viewed in FIG. 9, and the positioning lever 238 clockwise as viewed in FIG. 9. Both of the positioning levers 236 and 238 have very limited movement because of interaction with stops formed as a part of the bottom 60 of lower component housing 58. The normal position of levers 236 and 238 is as would be seen in FIG. 9. The lever 236 is free to rotate only approximatley 30° clockwise, such that a holding tab 242 located on its lower arm is depressed upon rotation of this lever. The lever 238 is free to rotate about 30° counterclockwise such that a holding tab 244 on its lower arm is lifted a short distance upon rotation of this lever.

The holding tabs 242 and 244 are positioned as is seen in FIG. 4 with respect to the drum 214 such that they can interact with the detent teeth 230 and 232. As is evident from viewing the drum 214 in FIG. 5, the detent teeth 230 and 232 are not in the same horizontal plane with respect to one another. The detent tooth 230 is in a lower horizontal plane than is the detent tooth 232. The holding tabs 242 and 244 are positioned such that the detent tooth 230 can contact the holding tab 242 when the lever 236 is in its extreme counterclockwise position and the detent tooth 232 can contact the holding tab 244 when the lever 238 is in its extreme clockwise position. If the lever 236 is rotated clockwise, the holding tab 242 is depressed below the plane of the detent tooth 230 and if lever 238 is rotated counterclockwise, the holding tab 244 is lifted above the plane of the detent tooth 232.

Because of the torque imparted to the drum 214 via the frictional engagement with the spring 218 and the top of pinion 220, the drum 214 is biased to rotate clockwise as seen in FIG. 4. This normally tends to position the detent tooth 230 against holding tab 242 of lever 236, holding the pinion 224 in engagement with the spur gear 226.

The plate 146 previously identified includes a small horizontal projection 246 located on its left hand side, which can be seen in FIG. 18. This contacts the wedge-shaped surface 248 located on the top of the vertical arm of the lever 236. If the plate 146 is rotated forward as viewed in FIG. 18 about its axles 148, the projection 246 on the plate pushes down against the wedge-shaped projection 248, causing the lever 236 to rotate clockwise, depressing the holding tab 242 below the plane of the detent tooth 230, allowing the drum 214 to rotate from the position seen in FIG. 4 to the position seen in FIG. 10. As will be remembered, the plate 146 is rotated whenever movement of the object member 96 is not coordinated with movement with the carriage 108. As remembered, this results in one of the trip members 142 or 144 being pushed against the plate 146 to move the same. This could be described as the "crash" or "accident" mode wherein the vehicle image 52 has encroached upon one of the road images 48 or 50. Such an encroachment would constitute a "crash" of the vehicle image 52.

After an "accident" or "crash" of the vehicle image 52, with the road images 48 or 50, the drum 214 is allowed to rotate clockwise until the detent tooth 232 contacts the holding tab 244 which then further restrains rotation of the drum 214. This positions the pinion 224 in engagement with the spur gear 232 to cause a certain sequence of events as hereinafter explained. Near the end of that sequence of events, a projection hereinafter identified and numbered, contacts the vertical arm of the lever 238 and rotates the same counterclockwise as viewed in FIG. 9. This releases the holding tab 244 from its engagement with the detent tooth 232, allowing the drum 214 to rotate clockwise until the holding tab 242 engages the detent tooth 230, once again positioning the pinion 224 in engagement with the spur gear 226 as seen in FIG. 4. It is thus evident that the drum 214 in conjunction with the levers 236 and 238 and the appropriate detent teeth 230 and 232 and tabs 242 and 244 act as a switch with regard to the propagation of the rotation by the pinion 224.

During the normal running cycle of the toy 30 when the vehicle image 52 is successfully maintained between the road images 48 and 50, the pinion 224 is engaged with the spur gear 226. The rotation of the spur gear 226 is transferred to axle 250 as follows. A collar 252 is fixed mounted to the axle 250. The collar 252 carries a small tab 254 on its underside. The spur gear 226 carries an upward extending tab 256 which is capable of interacting with the tab 254 to propagate the rotation of the spur gear 226 to the axle 250. The presence of the two tabs 254 and 256 allow for a delay of slightly less than one rotation between the initiation of transfer of rotation from the spur gear 226 to the axle 250. Rotation of the axle 250 ultimately drives the carriage 108 as well as the sub carriages 132 and 134. The above noted delay between transfer of motion from the spur gear 226 to the axle 250 allows for movement of an electronic switch member prior to rotation of the axle 250 and components down stream from it, as follows.

Figure 11:
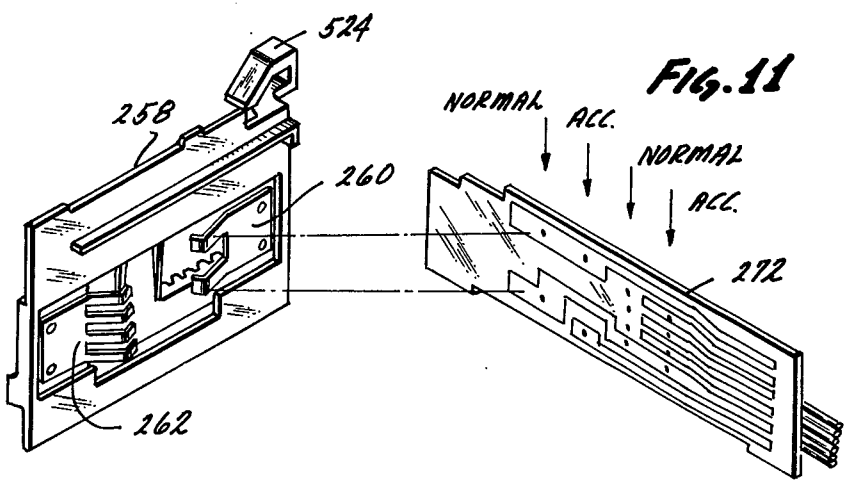
FIG. 11 is an exploded oblique view of certain of the components of FIG. 10.

Referring now to FIGS. 10 and 11, a plate 258 having a first electrical contact 260 and a second electrical contact 262 located thereon is slidably mounted in the upper left hand corner of the lower component housing 58 as seen in FIG. 4. The plate 258 carries a rack of gear 264 on it. The rack of gears 264 are positioned such that they can interact with pinion 266 integrally formed with spur gear 228 or pinion 268 integrally formed with spur gear 270. As is evident from FIG. 4, spur gear 226 meshes with spur gear 270.

When the drum 214 is positioned as seen in FIG. 4, rotation of pinion 224 is transferred to spur gear 226 which in turn tranfers it to spur gear 270. Pinion 224 rotates counterclockwise in response to the output of motor 198. The counterclockwise rotation of pinion 224 rotated the spur gear 226 clockwise and this in turn rotates the spur gear 270 counterclockwise. The rotation of the spur gear 270 counterclockwise is transferred to the pinion 268 formed as a part thereof, to rotate it counterclockwise and interaction of the pinion 268 with the gear rack 264 moves the plate 258 to the left in FIGS. 4 and 10, until contact is lost between the pinion 268 and the gear rack 264. At this point, the plate 258 stays in its left side position.

When the drum 214 is allowed to rotate to the "accident" or "crash" position as seen in FIG. 10, the pinion 224 meshes with the spur gear 228, which in turn rotates the pinion 226. When the plate 258 is in its left hand position, the gear rack 264 has engaged with the pinion 226. Counterclockwise rotation of the pinion 224 results in clockwise rotation of the pinion 266 and this clockwise rotation will then be transferred to the plate 258 to move the plate to the right, or to a right hand position until such time as the gear rack 264 is no longer in engagement with the pinion 266, but in fact has reengaged pinion 268. When the drum 214 is in the position as seen in FIG. 10, the pinion 224, however, is not driving the spur gear 226 and as such, the pinion 268 will be rotated by the gear rack 264 as the plate 258 moves to the right. The rotation of the pinion 268 will in turn rotate the spur gear 226 a small amount, however this will not be transferred to the axle 250 because of the indirect linkage of the spur gear 226 to the axle 250 via the tabs 254 and 256.

It can be seen then, that when the drum 214 rotates such that the pinion 244 disengages from the spur gear 228 and engages the spur gear 226, this causes movement of the plate 258 to the left and when the drum 214 rotates such that the pinion 224 disengages the spur gear 226 and engages spur gear 228, this causes movement of the plate 258 to the right. The left and right movement of the plate 258 results in a mechanical interaction of other components hereinafter identified which are located in the upper component housing 64. It further causes switching in the electrical circuitry of the toy 30 as follows.

A plate 272 formed of a dielectric material carries a printed circuit board on it, as is evident from FIG. 11. The printed circuit board on the plate 272 interacts with the contacts 260 and 262 such that as the plate 258 moves, the contacts 260 and 262 position themselves against different circuit elements on the plate 272. During the normal running cycle, the contacts 260 and 262 would contact the positions to the far left in FIG. 11 under the arrow on the extreme left hand side labelled "Normal". At this time the contacts 262 would contact the positions under the arrow the second from the right in FIG. 11, which is also labelled "Normal". This, of course, is when the plate 258 is in its left hand position.

Upon initiation of the "accident" or "crash" mode, when the pinion 224 engages the spur gear 226, the plate 258 is moved from the left, repositioning the contacts 260 in the position underneath the arrow which is second from the left, labelled "Accident", and the contacts 262 under the arrow on the far right hand side of FIG. 11, labelled "Accident". The exact circuit elements which are involved in repositioning the switch formed by the contacts 260 and 262 with the printed members on the board 272 will be discussed when the entire circuit of the game 30 is discussed below.

When the drum 214 is in the "accident" or "crash" mode, with the pinion 224 engaging the spur gear 228, rotation from the motor 198 is propagated to the upper housing 64 via the pinion 206 interacting with the spur gear 208 and driving the pinion 210. During the "accident" mode, no rotation is propagated to the axle 250. During the normal operation mode, the pinion 206 is also driven and still is able to transmit power to the upper housing 64 via the pinion 210, as well as propagating motion to the axle 250 via the interaction of the pinion 224 with the spur gear 226.

Motion is propagated from the spur gear 226 to the carriage 108 and the sub carriages 132 and 134 as follows. A pinion 274 is fixedly mounted to axle 250 and is rotated by axle 250 in response to rotation ultimately imparted to axle 250 by spur gear 226 interacting via the tabs 254 and 256. The pinion 274 meshes with a spur gear 276 which is formed around the bottom perimeter of a transmission gear 278. The transmission gear 278 is appropriately rotatably suspended on a boss, not separately identified or numbered, projecting upwardly from the bottom 60 of the lower component housing 58.

The transmission gear 278 includes three sets of crown gear teeth on its upper surface. These include slow crown gear teeth 280 which are located near the center of the transmission gear, intermediate crown gear teeth 282 which are located just outside the crown gear teeth 280, and fast crown gear teeth 284 which are located at the edge of the transmission gear 278, outside of intermediate gear teeth 282. A hollow area, not separately identified or numbered, is formed within the center of the slow crown gear teeth 280, with this hollow area serving as a neutral position.

Insofar as the intermediate teeth 282 have a greater radius than the slow teeth 280, there are a greater number of individual teeth on the intermediate teeth 282 than on the slow teeth 280. The same applies with respect to the fast crown gear teeth 284 with respect to the intermediate teeth. As such, for any constant rpm of the transmission gear 278, the transmission gear 278 is able to output a variety of speeds of rotation, depending upon which of its gear teeth, 280, 282 or 284, are engaged in the output.

A square axle, 286, is journaled in the top 62 of the lower component housing 58 such that it is free to rotate. The square axle 286 carries a pinion 288 in its center. The pinion 288 has a square opening allowing it to fit over the square axle 286 and be rotated by the square axle 286. However, the opening is oversized with respect to the size of the square axle 286 such that the pinion 288 is free to slide back and forth along the square axle 286. The pinion 286 is capable of engaging with each of the gear teeth 280, 282 or 284, and additionally is capable of being located dead center in the transmission gear 278 in the neutral position and as such, not engaged with any of the gear teeth located on top of the transmission gear 278.

Movement of the pinion 288 between its center neutral position to the slow crown gear teeth 280 results in a first output speed imparted to the pinion 288 and subsequent movement to the intermediate gear teeth 282 results in a second, intermediate output speed, and further subsequent movement to the fast crown gear teeth 284 results in a fast output speed imparted to the pinion 288.

The pinion 288 is moved between its four positions with respect to the transmission gear 278 in response to movement of the shifting lever 44. The shifting lever 44 is positionable in four positions corresponding to the above noted neutral, slow, intermediate and fast positions described in the preceding paragraph. The shifting lever 44 is formed as a part of a shifting member 290 located in the upper component housing 64. The shifting member 290 is rotatably mounted about an axle 292 fixed in the upper component housing 64. The shifting lever 44 moves in an arc centered about the center of the axle 292.

The shifting member 290 contains a slot 292 which is helical in shape because of its location on a cylindrical portion of the shifting member 290. A projection 296 fits into the slot 294 and as the shifting lever 44 is rotated about the axle 292, the projection 196 is moved axially with respect to the axle 292 as it rides in the slot 294. The projection 296 is formed on the upper end of a lever 298 which is pivoted about a boss, not numbered or seen, formed on the front plate 68 of the upper component housing 64, which fits into an appropriate bearing opening 60 formed in the lever 298. On the lower end of the lever 298 is a second projection 302.

Figure 15:
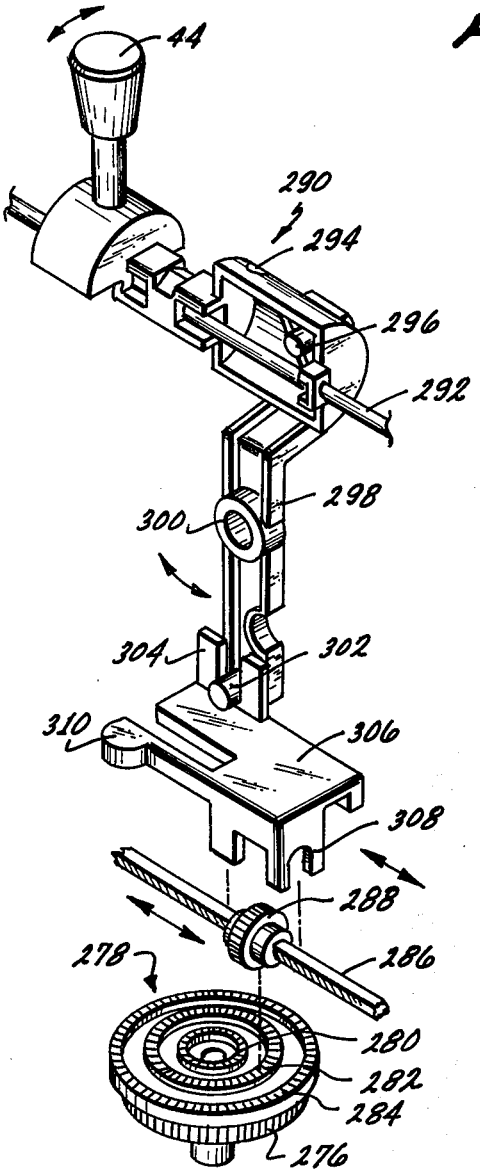
FIG. 15 is an oblique view, a portion of which is exploded, of one component seen in FIG. 1, and other components which are hidden behind and below it, as well as a component located in the upper central portion of FIG. 4.

The projection 302 is caused to move arcuately back and forth as seen in FIG. 15, in response to the arcuate movement of the shifting lever 44. The plane of movement of the shifting lever 44 however, is perpendicular to the plane of movement of the projection 302 because of the helical slot 294. A yoke 304 fits about the projection 302 in a loose manner allowing for communication of motion from the projection 302 to the yoke 304 without binding of these two components together. The yoke 304 is formed as a part of sliding member 306. The sliding member 306 slides on top of the top housing 62 of the lower component housing 58 in a position directly over the transmission gear 278. The sliding member 306 includes two yokes, only one of which, yoke 308, can be seen on its lower surface. The second yoke is exactly equivalent to the yoke 308 and is displaced slightly to the left of it. The two yokes 308 fit over the top of the square axle 286 with the pinion 288 located between them underneath the sliding member 306. As the sliding member 306 moves in response to pivoting of the lever 298, this motion is transferred to the spur gear 288 to move the same along the axle 286. Of course, movement of the spur gear 288 across the top of the transmission gear 278 engages the spur gear 288 within the four positions discussed above, wherein it can be oriented with respect to the transmission gear 278. The sliding member 306 includes an arm 310 having a detent on the end thereof which fits against a convoluted surface not shown or numbered, on the top 62 of the lower component housing 58. The arm 310 frictionally engages this surface in four distinct positions to maintain the pinion 288 in its four positions with relationship to the transmission gear 278.

Referring back to FIG. 5, after rotary motion is transferred to the pinion 288, the pinion 288 in turn transfers this motion to its axle 286. The axle 286 includes a second pinion 312 fixedly mounted to it. The pinion 312 rotates in response to rotation of the axle 286. The pinion 312 meshes with a crown gear 314. Crown gear 314 is part of a complex gear which includes a pinion 316 located over the crown gear 314 and a spur gear 318 located directly underneath it. All three of these are fixedly attached to an axle 320 about which they are mounted. The pinion 316 serves as a connecting point for the transmission of rotary output to other components hereinafter identified and numbered which are located in the upper component housing 64 and which ultimately drive the skill indicator 40. The spur gear 318 serves as a connecting point for the transmission of rotary output to other components hereinafter identified and numbered which are associated with the skill shift lever 46, as well as a shifting mechanism hereinafter described which governs the movement of the carriage 108.

A drum 322 similar to the drum 214 previously described, is located beneath the spur gear 318. The drum 322 is rotatably mounted about the axle 320, however is not directly connected to the axle 320, but is frictionally engaged to it via a spring 324 which pushes down on the drum 322 and tends to bias it toward a pinion 326 located below the drum 322. The pinion 326 is fixedly mounted to the axle 320. The drum 322 carries a small axle 328 on its lower surface about which is mounted a pinion 330. Pinion 330 engages pinion 326 and is rotated in response to rotation of pinion 326.

The drum 322, its spring 324, its two pinions 326 and 330 associated with it, as well as its axle 328, on which pinion 330 is mounted, are equivalent in function to the drum 314 and the equivalent parts associated with it. As such, a detailed description of the operation of these components is not necessary. Drum 322 does differ from drum 314 in one manner, however, and this is in regard to the number of detent teeth which it carries. Six detent teeth, 332, 334, 336, 338, 340 and 342 are located about the perimeter of drum 322. These detent teeth are arrayed in two groups, with a first group consisting of detent teeth 334, 338 and 342 being located near the upper surface of drum 322 with detent teeth 332, 336 and 340 being located near the lower surface of drum 322. The detent teeth moving circumferentially around the perimeter of the drum 322 alternate between one being located near the upper surface, followed by one being located near the lower surface, followed by one being located near the upper surface, etc., as is evident from viewing FIG. 5.

A holding tab 344 is located on one end of a shifting member 346. The shifting member 346 is mounted about an axle 348 in the bottom 60 of the lower component housing 58. As hereinafter explained, the shifting member 346 is caused to rotate about its axle 348 such that the holding tab 344 is positioned such that it can engage the detent teeth 334, 338 and 342 when the holding tab 344 is in its uppermost limit of travel and the detent teeth 332, 336 and 340 when the holding tab 344 is at its lower limit of travel.

Figure 6:
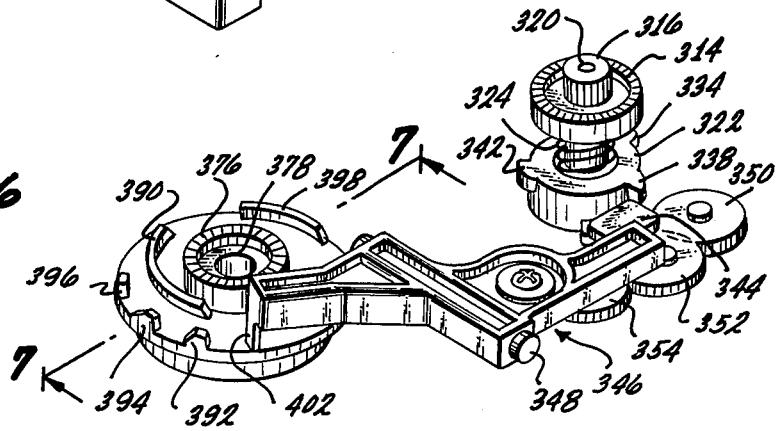
FIG. 6 is an oblique view of certain of the components seen in FIG. 4 which are positioned generally in the upper right hand portion of FIG. 4.

The interaction of the holding tab with the drum 322 is also seen in FIG. 6.

Four spur gears, spur gears 350, 352, 354 and 356, are arranged in a gear train moving clockwise from about the one o'clock position to the seven o'clock position as seen in FIG. 4. Spur gear 350 meshes with spur gear 352, this spur gear 352 then meshing with spur gear 354 and finally spur gear 354 meshes with spur gear 356. Each of the spur gears 350, 352, 354 and 356 are positioned such that pinion 330, which as noted above is carried by drum 322, can mesh stepwise with each of them. As seen in FIGS. 4 and 5, the pinion 330 is meshed with the spur gear 354.

Interaction of the holding tab 344 with detent tooth 332 meshes pinion 330 with spur gear 350. Interaction of the holding tab 344 with detent tooth 342 meshes the pinion 330 with spur gear 352. Interaction of holding tab 344 with detent 340 meshes the pinion 330 with spur gear 354 and interaction of the holding tab 344 with detent tooth 338 meshes the pinion 330 with spur gear 356. When the holding tab 344 interacts with detent 336 the pinion 330 is located at approximately the eight o'clock position as viewed in FIG. 4, and when the holding tab 344 interacts with the detent 334 the pinion 330 is positioned at approximately eleven o'clock position as seen in FIG. 4. For these last two positions, the pinion 330 is not engaged with any of the spur gears 350, 352, 354 or 356, which, as noted above, are intermeshes together to form a gear train, and as such, at this time, rotation propagated via the transmission gear 278 to the crown gear 314 associated with the drum 322 is not further propagated.

As seen in FIG. 5, the spur gear 356 is mounted about an axle 358 which carries a pinion 360 also on it. Since the spur gear 356 and pinion 360 are fixed to the axle 358 rotation of the spur gear 356 is communicated to the pinion 360. The pinion 360 meshes with a set of gear teeth 362 formed around the disk 168 previously identified. As such, rotation of the spur gear 366 is communicated to the disk 168 and rotates the same, which, as noted above, results in movement of the carriage 108.

Because the spur gears 350, 352, 354 and 356 are all intermeshed, it is possible to drive the disk 168 by rotation of any one of the spur gears. The pinion 330 rotates in only one direction under the rotational motion ultimately transferred to it. Thus, when the pinion 330 engages the spur gears 350 and 354, the rotation of the disk 168 will be in one direction, and when it engages the spur gears 352 or 356, rotation of the disk will be in the opposite direction. Positioning of the pinion 330 with respect to one of the spur gears 350, 352, 354 or 356 thus serves to govern the direction of rotation of the disk 168. Further, as noted above, positioning of the pinion 288 with respect to the transmission gear 278 serves to govern the speed of rotation of the pinion 88 and thus the speed of rotation ultimately transferred via the pinion 88 to the pinion 330 and in turn, thus the speed of rotation of the disk 168 via the interconnecting gear trains described.

Additionally, position of the drum 322 in the two positions described wherein the pinion 330 is not engaged with any of the spur gears 350, 352, 354 or 356 serves to stop the transfer of any rotation to the disk 168 and thus serves to stop the movement of the carriage 108. Additionally, movement of the carriage 108 can be stopped by shifting the shifting lever 44 to the neutral position which positions the pinion 288 in the center of the transmission gear 278 and thus no rotation is transferred to the pinion 288 and ultimately to the disk 168 which in turn results in no movement of the carriage 108.

The speed of movement of the carriage 108 or the lack of movement is therefore under direct operator control via the shifting lever 44 and additionally is under a control mechanism hereinafter described over which the operator has no input, which positions the drum 322 in the six positions governed by the appropriate detent teeth 332, 334, 336, 338, 340 and 342. As such, there are two modes of control of movement of the carriage 108, that of the operator control and that of an automatic mechanical control.

Figure 7:
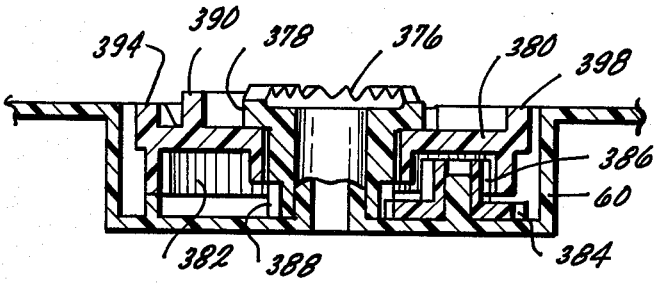
FIG. 7 is an elevational view in section about the line 7—7 of FIG. 6.

The automatic mechanical control functions as follows, reference being made to FIGS. 4 through 8. Spur gear 364 meshes with spur gear 318, which, as noted above, rotated in conjunction with crown gear 314. The spur gear 364 is mounted about an axle 366 which also carries a worm gear 368 on it. Worm gear 368 is thus ultimately rotated in response to rotation of spur gear 364. A pinion 370 meshes with worm gear 368 with pinion 370 being fixedly mounted to a shaft 372. On the opposite end of the shaft 372 is a second pinion 374. Pinion 374 meshes with crown gear 376 which is formed on the upper part of a circular member 378. The circular member 378, as can be seen in FIG. 7, fits in the center of a disk 380. On the underneath inside of the disk 380 is an internal set of gear teeth 382. A small gear having spur teeth 384 and a pinion 386 rests underneath within the interior of the disk 380. The pinion 386 meshes with the internal gear teeth 382 and the spur teeth 384 mesh with spur teeth 388 formed on the bottom of the circular member 378. By this arrangement, rotation of the crown gear 376 is transferred to the spur teeth 384 by the spur teeth 388 and in turn to the pinion 386, which then transfers rotation to the internal gear teeth 382, rotating the disk 380. However, the direction of rotation of the disk 380 is opposite to the direction of rotation of crown gear 376 because of the above gearing.

The disk 380 contains a plurality of raised surfaces on it. The first of these, surface 390, is displaced radially inwardly from the remainder of the surfaces. The remainder of the surfaces are surfaces 392, 394, 396, 398 and 400. A space exists between each of the surfaces 392, 394, 396, 398 and 400. Each of the surfaces delineated in the previous sentence are such that they include a wedge shape on their leading edge such that as the disk 380 rotates clockwise, this wedge shape can abutt up against end 402 of the shifting member 346. In the outer group of surfaces, surfaces 392, 394, 396, 398 and 400, there are five members, with a totality of five spaces not separately identified or numbered, located between them. As the disk 380 rotates, the above delineated surfaces and the spaces between them alternately are contacted by the end 402 of the shifting member 346. When the shifting member 346 is between any two of the above surfaces and rests directly on the top of the disk 380, the holding tab 344 is positioned to interact with one of the upper detents 334, 338 or 342 on the drum 322 and when the end 402 on the shifting member 346 is raised up on one of the surface 392, 394, 396, 398 or 400, the holding tab 340 on the shifting member 346 is depressed such that it interacts with the lower detents 332, 336 and 340. Thus, as the disk 380 rotates, the surfaces 392, 394, 396, 398 and 400 and the spaces between them appropriately interact with the end 402 to rotate the shifting member 346 about its axle 348 to raise and lower the holding tab 344 on the other end of the shifting member 346 to control the position of the drum 322.

Insofar as there are six detents on the drum 322 and five surfaces with five spaces in between on the disk 380, no one particular detent 332, 334, 336, 338, 340 or 342 is always associated with any particular surface 392, 394, 396, 398 or 400, or the spaces between them. Further, the spaces between the surfaces 392, 394, 396 are small, as is the space between surface 398 and 400, while the space between surface 396 and 398 and the space between space 400 and 392 is large. Additionally, the one surface 398 is large compared to the remainder of the surfaces. As a result of this, the end 402 of the shifting member 346 is either in contact with the surface of the disk 380 for variable periods of time, or raised above it for variable periods of time with these variable periods of time being communicated to the drum 322 such that the pinion 330 attaching to the drum 322 is meshed with the spur gears 350, 352, 354 and 356 as well as being located out of mesh with any of these spur gears for varying lengths of time. Insofar as this governs the rotation of disk 168, which governs the movement of the carriage 108, the movement of the carriage 108 back and forth within the toy 30 is a complex movement resulting from the permutations of the six detents being governed by the five surfaces and five spaces, with a variability introduced because of the differences in size of the surfaces and spaces.

The sub carriages 132 and 134 are also driven off of the crown gear 376. Pinion 404 mates with crown gear 376. The pinion 404 is attached to a shaft 46 which has a second pinion 408 near its opposite end. The end of the shaft 406 which includes the pinion 408 is loosely held to a shifting member 410 by a portion of a spring 412. The pinion 408 is not located on the very end of the shaft 406, but is spaced inwardly from the end 414 of the shaft 406.

A complex gear, gear 416 has a large diameter spur gear 418 and a small diameter spur gear 420 located on it. Gear 176 meshes with spur gear 418 and as noted above, rotation of the gear 176 ultimately results in movement of the sub carriages 132 and 134 on the carriage 108. Formed inside of the large spur gear 418 is a spiral groove 422. Because the groove 422 is spiral in nature, it has a shoulder 424 on it. The end 414 of the shaft 406 is positioned in to the groove 422. Except when the end 414 of the shaft 406 is located adjacent to the shoulder 424, the pinion 408 engages the spur gear 420 and rotation is then transferred to the gear 416, which in turn rotates the gear 176 for movement of the sub carriages 132 and 134. When the end 414 of the shaft 406 is lowered adjacent to the shoulder 424, the connection between the pinion 408 and the spur gear 420 is broken, and no rotation is transferred to gear 416.

Under the rotation imparted via crown gear 376, the pinion 408 rotates counterclockwise, as seen in FIG. 8, to rotate the gear 416 clockwise. If the end 414 of the shaft 406 is not held upwardly by the shaft member 410 as the gear 416 rotates, the end 414 will come to rest against the shoulder 424, breaking the connection between pinion 408 and gear 420, then further prevent any rotation of the gear 416. When this happens then, no rotation is transferred to the sub carriages 132 and 134.

The shifting member 410 is a first class lever pivotable about axles collectively identified by the numeral 426. It can be pivoted about the axles 426 via one of two mechanisms. The first mechanism is under the control of the skill shift lever 46 and the second mechanism is a mechanical mechanism governed by the inside raised surface 390 on the disk 380.

In looking at FIG. 8, it can be seen that the skill shift lever 46 is a first class lever pivoted about a bearing surface 427 which fits over a boss, not separately identified or seen, projecting upwardly from the bottom 60 of the lower component housing 58. Movement of the end of the skill shift lever 46 which is exposed outside of the toy 30 to the right as viewed in FIG. 8, will bring the other end 429 to rest underneath a projection 428 on the shifting member 410. This pivots the shifting member 428 about its axles 426 depressing the end 414 of the shaft 406 to initiate breaking of the connection between the pinion 408 and the spur gear 420. In this mode of operation at the lower skill level, there will be no movement of the sub carriages 132 and 134 in conjunction with movement of the carriage 108 and the road created by the road images 48 and 50 which the vehicle image 52 must traverse across the window 36 will be less complex, because it will only be dependent upon movement of the carriage 108 and not movement of the sub carriages 132 and 134 with respect to the carriage 108. When the higher skill level is desired, the exposed end of the shift lever 46 as seen in FIG. 8 would be moved to the left, disengaging the end 429 of the shifting member 410 from the projection 428, allowing the shifting member 410 to pivot about its axles 426 to connect pinion 408 with the spur gear 420. The spring 412 also contacts a raised portion of the bottom 60 of the lower component housing 58 to bias the shifting member 410 such that the pinion 408 is raised to engage spur gear 420. This, in turn, biases the other end 430 of the shifting member 410 downward on to the surface of the disk 380. The end 430 is located however, such that a disk 380 spins, the inside raised surface 390 on disk 380 can contact it. When it does contact it, it raises the end 430 pivoting the shifting member 410 such that the end 414 of the shaft 406 is biased downward, and when this end contacts the shoulder 424 contact between the pinion 408 and the spur gear 420 is broken and movement of the sub carriages 132 and 134 ceases.

Upon further rotation of the disk 380, however, the end 430 of the shifting member 410 slides off of the inside raised surface 390 and once again contacts the top of the disk 380 to once again pivot the shifting member 410, which in turn engages the pinion 408 against the spur gear 420 to once again start movement of the sub carriages 132 and 134.

The drum 214 serves as a switch to, in a first instance, propagate motion via a first drive sequence to the gears associated with the drum 322 to drive the carriage 108 and at times the sub carriages 132 and 134 or, in a second instance, to drive certain mechanisms in a second drive train which governs the functions of other components which are used to indicate a "crash" or "accident" mode, resulting in improper coordination between movement of the vehicle image 52 and the imaginary road created by the road images 48 and 50. Whenever, in a first instance, when motion is propagated to the gears associated with drum 322, this motion is recorded by the skill indicator as follows.

Figure 16:
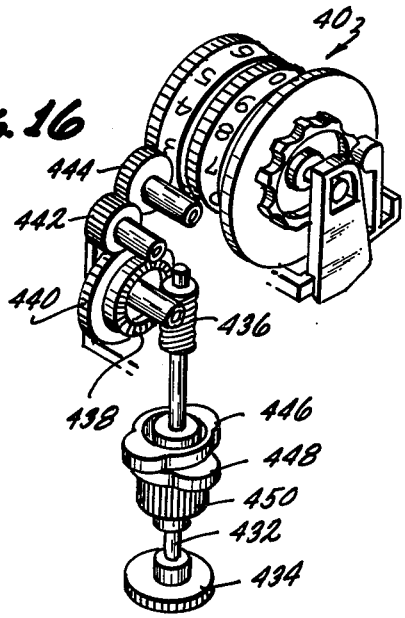
FIG. 16 is an oblique view of certain of the components located on the right hand side of FIG. 12.

Referring now to FIG. 16, and briefly to FIG. 5, a shaft 432 is located in the upper component housing 64 and has a spur gear 434 on its lower end. The spur gear 434 meshes with the pinion 316 associated with the axle 320 about which the drum 322 is rotated. Rotation from the transmission gear 278 is transferred as above, to rotate the pinion 316 which, in turn then rotates the spur gear 434, transferring this motion to the shaft 432.

A worm gear 436 located on shaft 434 meshes with a crown gear 438 which also has a spur gear 440 associated with it. Motion from the spur gear 440 is transferred via pinions 442 and 444 to a counting mechanism. This counting mechanism is essentially as illustrated and described in U.S. Pat. No. 4,241,925, assigned to the same assignee as this application. For brevity of this specification, the description of the counting mechanism in the referred to patent is herein incorporated by reference. This counting mechanism has both a units wheel and a tens wheel and is capable of being reset to a zero position as is described in that U.S. patent.

Referring now to FIGS. 12 and 16, shaft 432 also carries two cams, cam 446 and cam 448, on it, as well as a spur gear 450. The cams 446 and 448 abutt against certain electrical contacts hereinafter discussed when the electrical circuit of this application is discussed, to open and close these contacts and the gear 450 in conjunction with a spring arm 452 emits a noise which is indicative of rotational movement being imparted through the drive train which drives the carriage 108. When the drum 214 is switched such that the drive train to the carriage 108 is broken, the shaft 432 is no longer rotated, which results in stopping of tallying of points on the skill indicator 40, the ceasing of the flashing caused by the movement of the cams 446 and 448 and the loss of the noise created by the gear and spring arm 450 and 452, respectively, which is associated with the motion being transmitted to drive the carriage 108.

Figure 17:
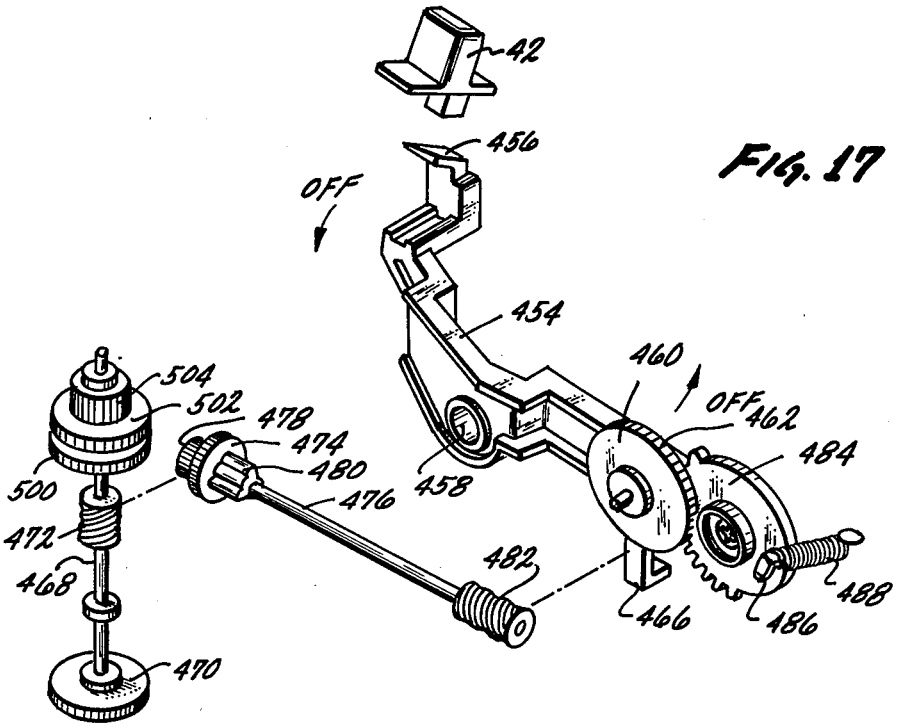
FIG. 17 is an exploded view showing an additional component seen in FIG. 1 and other components which are hidden from view and lie below and behind this component.
Figure 22:
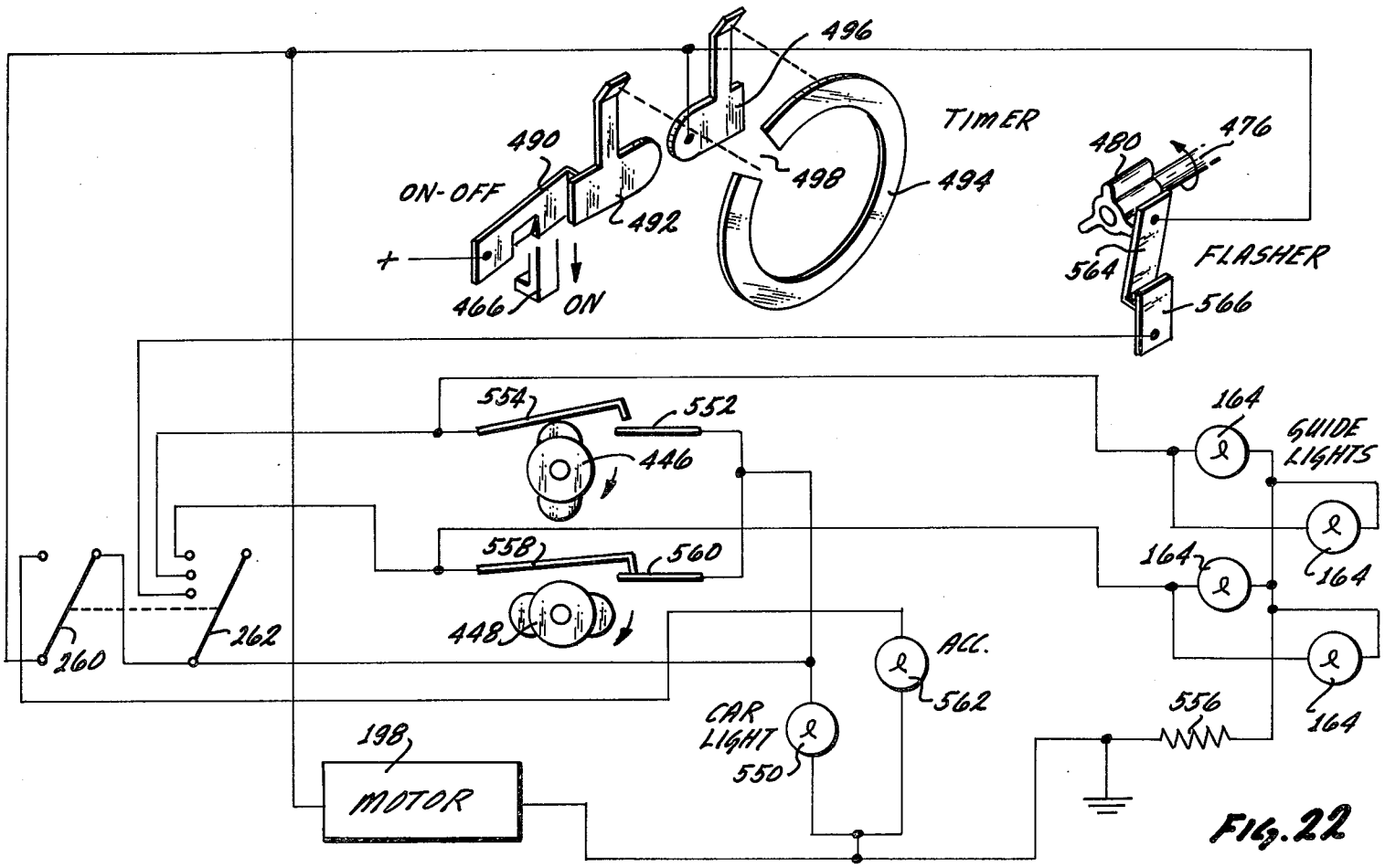
FIG. 22 is a diagramatic view of the electronic circuit of the toy of FIG. 1.

Referring now to FIGS. 12 and 17, operation of the off/on and timing function will be described. Additionally, reference to the circuit of FIG. 22 is made. A lever 454 is pivotally mounted within the upper component housing 64 on a boss, not numbered or seen, located on the front plate 68 of that housing. On the left hand side of the lever, as viewed in FIG. 17, there is a wedge shaped projection 456. The bottom of the off/on button 42 contacts the projection and rides against it to rotate the lever 454 upwardly and downwardly about its point of pivot at bearing 458.

A gear 460 is rotatably mounted on the other end of the lever 454. The gear 460 has a set of large spur teeth 462 as well as a set of small spur teeth 464, which are displaced behind the teeth 462 in FIG. 17. Additionally, an arm 466, formed as an integral part of the lever 454, extends downwardly beneath the bottom of the gear 460.

A shaft 468, seen on the left hand side of FIG. 17, has a spur gear 470 on its lower end. The lower end of shaft 468 extends out of the upper component housing 64 and down into the lower component housing 58 such that the spur gear 470 meshes with pinion 210, previously described. It will be remembered that pinion 210 is rotated by the motor 198 via the gear train consisting of crown gear 202 and pinion 206, which transfers rotation to the spur gear 208 attached to the pinion 210. As such, whenever the motor 198 is activated, the spur gear 470 is being rotated. This transfer of motion to the spur gear 470 via the pinion 210 is seen in FIG. 5.

Referring again to FIGS. 12 and 17, rotation of the pinion 270 results in rotation of the shaft 468 and of a worm gear 472 attached to the shaft 468. The worm gear 472 meshes with a spur gear 474 which is attached to a shaft 476. Integrally formed with the spur gear 474 is a pinion 478 and a flasher cam 480 which rotate in conjunction with rotation of spur gear 474. Rotary motion imparted to the spur gear 474 is transferred by the shaft 476 to a worm gear 482.

When the off/on switch 42 is shifted to the "off" position, the lever 454 is rotated counterclockwise about its bearing 458. In this position, the spur gear 460 is positioned slightly above the worm gear 482 but does not contact the same. When the off/on button 42 is pushed to the "on" position, the button 42 acting against the wedge 456 rotates the lever 454 clockwise such that spur gear 460 descends downwardly and contacts worm gear 482. This meshes the spur gear 460 with the worm gear 482 and additionally, meshes the spur gear 464 with a sector gear 484.

The sector gear 484 is mounted to the front plate 68 of the upper component housing 64 to the right of the gear 462. When the off/on button is in the "on" position, rotation of the gear 462 is transferred via the spur gear 464 to the sector gear 484, rotating the sector gear 484 clockwise. When the off/on button 42 is pushed to the "off" position and the gear 462 is raised upwardly in response to counterclockwise rotation of the lever 454, the spur gear 464 disengages with the sector gear 484. The sector gear 484 has a tab 486 located on it to which attaches a spring 488. The other end of the spring 488 is attached to the inside of the front plate 68 of the upper component housing 64. Any clockwise rotation imparted to the sector gear 484 by the gear 464 tenses and stretches the spring 488. When the off/on button is switched to the "off" position, and the spur gear 464 disengages from the sector gear 484, the tension thus created in the spring 488 rotates the sector gear 484 counterclockwise to reset the timing mechanism, as explained below.

Referring to the diagram shown in FIG. 22, it can be seen that the arm 466 on the lever 454 is positioned adjacent to an electrical contact 490. This contact is connected to the positive terminal on the batteries 72. When the off/on button 42 is in the "off" position, the arm 466 wedges against the contact 490, displacing the contact 490 away from a second electrical contact 492. This breaks the circuit between the contacts 490 and 492. When the off/on button 42 is pushed to the "on" position, the arm 466 descends in response to movement of the lever 454 and in doing so, moves away from the contact 490, allowing it to move against the contact 492 to complete an electrical circuit between the contacts 490 and 492.

A metallic ring 494 is mounted on the back of the sector gear 484. Located adjacent to the ring 494 is electrical contact 492 as well as electrical contact 496. The ring 494 is incomplete and includes a slot 498 in its surface. After turning on the toy 30 with the off/on button 42, and after playing with the same for a predetermined amount of time, motion from the motor 198 is ultimately conducted up to the gear 462 as previously described. This in turn rotates the sector gear 484 clockwise. Upon initiation of starting of play of the game, and during subsequent play, both of the electrical contacts 492 and 496 contact the ring 494 and a circuit is thus made between contact 492 to contact 496 by passing through the ring 494. After the sector gear 486 has rotated clockwise through approximately 90° of rotation, the slot 498 will become positioned in line with the electrical contact 492. This allows the electrical contact 492 to slip off of the ring 494 into the area of the slot 498 against the back side of the sector gear 484. The sector gear 484 is formed of a dielectric material and is non-electrical conducting. When the electrical contact 492 slips into the slot 498, the circuit from the electrical contact 492 to the electrical contact 496 is broken. Since the off/on function governed by electrical contacts 490 and 492 and the timer function governed by electrical contacts 492 and 496 are in series with the positive terminal of the battery 72, upon location of electrical contact 492 in the slot 498 the circuit from the positive terminal of the battery 72 is broken, shutting off the toy 30. The off/on button 42, however, remains in the "on" position when this happens. To restart the game, the off/on button 42 is switched to the "off" position, which releases the spur gear 454 from the sector gear 486, allowing rotation of the sector gear 484 to once again reposition electrical contact 492 against the ring 494 for the start of a new play sequence of the toy 30.

As seen in FIGS. 12 and 14, located on shaft 468 above worm gear 474 is a spur gear 500. The spur gear 500 is fixed to the shaft 468 and thus, as with shaft 468, is continually rotating as long as the motor 198 is producing an output. Located above spur gear 500 is a combination gear having a spur gear 502 and a pinion 504 integrally formed together. The spur and pinion, 502 and 504, are freely mounted on shaft 468 and do not rotate in conjunction with the rotation of shaft 468. Normally, these two gears, 502 and 504, remain stationary except during the "crash" or "accident" mode.

A crown gear 506 meshes with the pinion 504. The crown gear 506 is mounted to shaft 82 previously described with respect to the steering mechanism of the toy 30. Located on shaft 82 adjacent to crown gear 506 is worm gear 508. Both the crown gear 506 and the worm gear 508 are fixed to the shaft 82 as was the previously described cam gear 84. The steering gear 86, however, is not fixed to the shaft 82 and rotates independent from the shaft 82.

An axle 510 is mounted perpendicular to shaft 82 and carries on it a pinion 512 and a crank disk 514 having a crank pin 516 attached thereto. The crank pin 516 engages in a slot 518 formed in a sliding member 520 seen in FIG. 12. During the "accident" or "crash" mode, in response to rotation of axle 510 by pinion 512, the crank pin 516 moves the sliding member 520 back and forth on the inside of the rear plate 66 of upper component housing 64.

The sliding member 520 has a plurality of slits 522 formed in it, as does the rear plate 66 of the upper component housing 64. The slits in the rear plate 66 are not shown nor numbered. However, these slits, in combination with the slits 522 in the sliding member 520 allow for the transmission of light from a small light, hereinafter identified and numbered, which is located behind the sliding member 520 against the front plate 68 of the upper component housing 64. During the "crash" or "accident" sequence, when the slits 522 in the sliding member 520 line up with the slits in the rear plate 66 of the upper component housing 64, light is passed through the lined up slits to the one way mirror 56, and is reflected back out of the window 36. This gives a visual image that a "crash" or "accident" has occurred because of lack of coordination of movement of the vehicle image 52 with respect to the road image 48 and 50.

Additionally during the "crash" mode, also in response to rotation of the axle 82, the cam gear 84 rotates against the bottom of the steering shaft 74, causing the steering shaft 74 to move up and down to transmit a tactile sensation to the operator of the toy 30, further indicating that a "crash" or "accident" has occurred.

Rotation is imparted to shaft 82 as follows. The plate 258 seen in FIG. 11 in side view, and in FIGS. 4 and 10 in top plan view, includes a wedge 524 on its top left hand edge as seen in FIGS. 4 and 10.

As seen in FIGS. 12 and 14, a shaft 526 is positioned in a parallel arrangement with shaft 468. Shaft 526 is mounted in the upper component housing 64 such that it is free to move up and down parallel with the shaft 468. A wide pinion 528 is freely mounted about shaft 526. It is biased downwardly against a bushing 530 via a spring 532. On the upper end of the spring 532 is a washer 534. The washer 534 pushing against the spring 532, which in turn pushes against the pinion 528, and ultimately against the bushing 530, biases the shaft 530 downwardly as seen in FIG. 12.

When the shaft 526 is in the downward position as seen in FIG. 12, the pinion 528 is meshed with spur gear 500, which was noted as being fixedly attached to shaft 468. The pinion 528, however, during this normal running cycle, is not engaged with spur gear 502. Since gear 502 is freely mounted about shaft 468, rotation of shaft 468 during the normal mode of operation is not transferred via spur gear 502 to pinion 504 and to crown gear 506 to either the sliding member 520 or to cam gear 82 to move the steering column up and down.

Shaft 526 additionally carries a circular member 536 fixedly attached to it. The circular member 536 includes a crown gear 538 on its upper surface. The crown gear 538 during the normal mode of operation is spaced downwardly from pinion 478 which is located on shaft 476. Thus, during normal operation, no rotation is transferred from shaft 468 via pinion 478 to circular member 536 nor shaft 526 on which it is carried.

Upon initiation of the "accident" or "crash" cycle, the plate 258 was noted as moving to the right with respect to its position in the upper left hand corner of the lower component housing 58 as seen in FIG. 4. Upon moving to the right, this engages the wedge 524 on the plate's upper left hand corner against the end 540 of the shaft 526. As the plate 258 moves to its extreme right hand position, the end 540 of the shaft 526 rides up on the wedge and moves the shaft 526 upwardly into the position as seen in FIG. 14.

When shaft 526 is lifted, the pinion 528 now engages both spur gears 500 and spur gears 502. In so doing, rotation of shaft 468 is transferred via spur gear 500 to pinion 528 and from there to pinion 502, and ultimately to shaft 82 for activation of the sliding member 520 and the up and down movement of the steering shaft 74. Additionally, the circular member 536 is raised, engaging the crown teeth 538 with pinion 478. In so doing, rotation from shaft 468 is transferred to shaft 526 to rotate shaft 526.

The circular member 536 contains a downwardly projecting peg 542. During the normal operation cycle, this peg 542 extends through an opening, not numbered or seen, formed in the bottom wall 544 of the upper component housing 64. This opening would be directly behind the bottommost portion of the shaft 526 as seen in FIG. 12. Additionally, the circular member 536 includes a horizontally projecting shift member 546.

As shaft 526 is rotated via rotation imparted to it via pinion 478 acting through shaft 468, the peg 542 is rotated past the opening in the bottom wall 544 and is lodged on the top surface of this bottom wall. This maintains the shaft 526 in its upward position irrespective of it being held upwardly by the interaction of the end 540 of this shaft against the wedge 524. The circular member 536 then proceeds to make one full revolution under the drive imparted to it via pinion 478 acting against crown gear 538. This swings the horizontally projecting shift member 546 around through a circular pathway. Near the end of the revolution, the shift member 546 contacts the upper end 548 of second positioning lever 238. As viewed in FIG. 14, the circular member 536 would be rotating such that the horizontal shift member 546 is moving from its left hand position toward the observer and then on to the right hand side of the shaft 526 and then toward the back side of the circular member 526. As the shift member 546 moves to the back side of the circular member 536 it contacts the upper end 548 of the second positioning lever 238. This moves the upper end 548 of the second positioning member 238 to the left, or counterclockwise, as viewed in FIG. 9, lifting the holding tab 244 on its other end upwardly such that it releases from the upper detent 232 on drum 214. This allows drum 214 to rotate, repositioning the pinion 224 which is carried by this drum, which ultimately causes the plate 258 to slide to the left, displacing the wedge 524 from the bottom 540 of the shaft 526. Additionally, the peg 542 once again encounters the opening in the bottom wall 544 of the upper component housing 64. With the wedge 524 no longer located below the end 540 of the shaft 526 and with the peg 542 positioned over the above noted opening, the shaft 526 is allowed to descend, disengaging the crown gear 538 from the pinion 578 and the wide pinion 528 from the spur gear 502. In doing so, the motion of the sliding member 520 and the steering shaft 74 associated with the "accident" or "crash" mode cease and operation of the toy 30 returns to the driving mode wherein the carriage 108 is now once again powered.

As is evident from the above description, when shaft 526 is lifted the "accident" or "crash" mode indicators are operative and when it lowered they are inactivated.

Referring now to FIG. 22, the electrical circuit will be discussed. Where appropriate in FIG. 22 the mechanical components previously described which interact with the electrical circuit are shown representationally and are identified with the same numeral which was utilized to identify the mechanical equivalent.

The electrical contacts 490 and 492 constituting the off/on switch have been previously discussed, as have the contacts 492 and 496 which, in conjunction with the ring 494 constitutes the timing switch. During normal mode of operation, the circuit from the electrical contact 496 is fed through the motor 198 and then to ground, and additionally, fed through contact 260 on the plate 258 to a light 550 which is placed inside the opaque housing constituting the vehicle 100. This lights up the vehicle 100 such that its image can form the vehicle image 52 displayed through the window 36. The circuit through the light 550 also leads to ground. Additionally, branching off from the circuit at the light 550, the circuit includes electrical contact 552, which is associated with contact 554, which is engaged by flasher cam 446. When a circuit is complete between the contacts 552 and 554, the circuit then feeds to two of the LED's 164, which are connected through resistor 556 to ground. A second circuit, in parallel with the one just immediately described, includes electrical contacts 558 and 560 which are associated with flasher cam 448. These complete a circuit through the other two LED's 164 which are also tied to resistor 556 and then to ground.

During normal operation then, the circuit from the last timer electrical contact 496 branches off through the motor 198 and to electrical contact 260, and from there through both the car light 550 and the two flashing circuits which alternately flash the four LED's 164 two at a time. One of the LED's 164 associated with the flashing cam 446 will be located on the right following member 156 with the other of the LED's associated with the flasher cam 446 located on the left following member 154. The same is true with the two LED's 164 associated with flasher cam 448, one will be located on the right following member 156 and the other on the left following member 154.

During the "crash" or "accident" mode, the plate 258 slides, repositioning the electrical contact 260 such that it breaks the circuit to the car light 550 but completes a circuit through an accident light 562. The accident light 562 is positioned behind the sliding member 520 such that light can be emitted through the slits 522 in the sliding member 520 as the sliding member 520 moves. Further, the movement of the plate 258 completes a circuit through electrical contact 262.

A lead from the timing electrical contact 496 leads to flasher contact 564 which alternately is in electrical contact with flasher contact 566 as it is moved by flasher cam 480. Flasher electrical contact 566 is in circuit with electrical contact 262 during the "accident" or "crash" mode. This feeds an electrical pulse governed by the movement of the flasher cam 480 to the car light 550 and also to the LED's 164. The circuit through the element 262 to the LED's 164 bypasses the electrical contacts associated with the flasher cams 446 and 448 and completes the circuit through the LED's 164 to the contact associated with the flasher cam 480. Because both the car light 550 and the LED's 164 are connected through the electrical contacts 564 and 566 associated with the cam 480, they flash in sync during the "accident" or "crash" cycle.

During the "accident" or "crash" cycle", the circuit is maintained through the motor 198 to maintain the appropriate rotational output to the elements which drive the mechanical elements described above associated with the "crash" or "accident" indications.

Upon movement of the plate 258 after the completion of the "crash" or "accident" mode, the circuit passing through electrical contact 262 is broken, and the circuit passing through electrical contact 260 to the accident light 562 is broken, but the circuit to the car light 550 is re-established for resumption of the normal operation of the toy 30.

Figure 23:
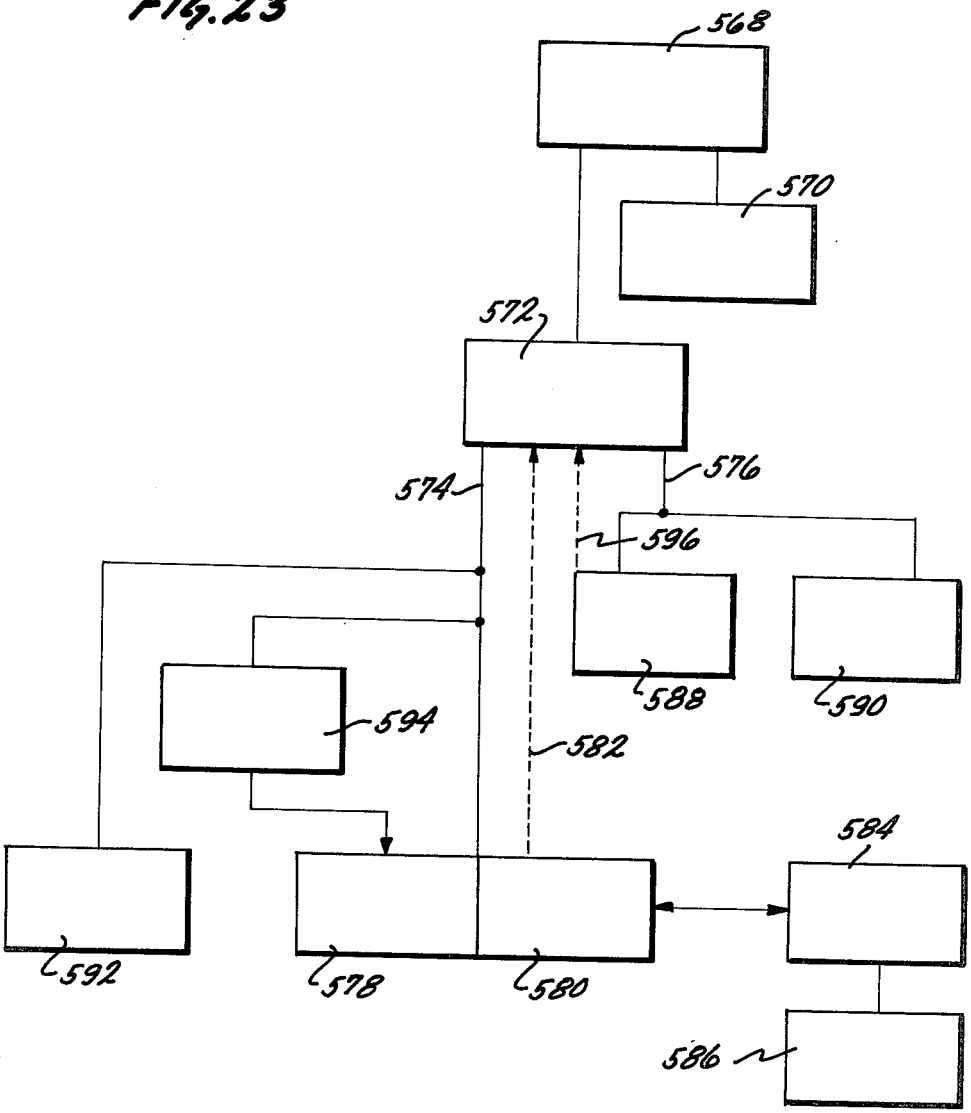
FIG. 23 is a diagramatic representation of the operation of the toy of FIG. 1.

In reference now to FIG. 23, a diagramatic illustration of the operation of the toy 30 is shown. A power source 568 which would include the batteries 72 and the motor 198 is controlled by an off/on and timer control 570. This, of course, would include those elements associated with the off/on button 42 and the timer ring 494 and the like.

The power source 568 feeds an output to a switch 572. The switch in turn is capable of transmitting an output to a first drive 574 or a second drive 576. The switch 572 of course would represent the drum 214 and the elements associated with it. The first drive 574 would include those elements which feed mechanical output to the carriage 108 and the sub carriages 132 and 134. The second drive 576 would include those elements which feed output to the shaft 82 for driving the "accident" or "crash" mode indicator. Additionally, it would feed mechanical output to the circular member 536 which serves as a timing device for the "crash" or "accident" cycle.

In FIG. 22 the first drive 574 is connected to a mover 578 which of course would include the carriage 108 and the sub carriages 132 and 134. The mover 578 carries an encounter sensor 580 on it which would be associated with the trip members 142 and 144 as well as the plate 146. The encounter sensor 580 feeds back to the switch 572 via trip feedback line 582.

An obstacle 584 is representative of the object member 96 and the trip tabs 150 and 152. The obstacle 584 is controlled by the obstacle controller 586 which, of course, would be representative of the steering wheel 38 and the elements located between it and the object member 96.

The second drive 576 feeds output to an indicator timer 588 which, as noted above, is representative of the circular member 536 and its associated parts and drives. Additionally, the second drive 576 feeds output to an encounter indicator 590 which also as noted above, is representational of the shaft 82 and the "accident" or "crash" indicators associated with it.

The movement of the mover 528 can be complexed by the motion complexer 594 which is representative of drum 322, the shift member 346, the disk 380 and all of the elements associated with these components.

The counter 597 is representative of the skill indicator 40 and all of the components which drive it.

I claim:

1. A toy which comprises:

a housing;

a mechanical output means located in said housing and capable of producing a mechanical output;

a switching means located in said housing in operative association with said mechanical output means, said switching means receiving said mechanical output from said mechanical output means and capable of further transmitting said mechanical output so received;

a first output transferring means and a second output transferring means each operatively associated with said switching means, said switching means in a first switching mode capable of transferring said mechanical output to said first output transferring means and in a second switching mode transferring said mechanical output to said second output transferring means, each of said first and said second output transferring means capable of further transferring said mechanical output so received;

a movable means located in said housing in operative association with said first output transferring means and capable of receiving said mechanical output from said first output transferring means and in response to receipt of said mechanical output moving in said housing;

an object means located in said housing;

an encounter sensing means located in said housing with at least a portion of said encounter sensing means located on said movable means and movable in conjunction with movement of said movable means, said encounter sensing means capable of sensing if said movable means encounters said object means as said movable means moves in said housing and when said encounter sensing means senses an encounter between said movable means and said object means said encounter sensing means activating said switching means to switch from said first switching mode to said second switching mode such that said switching means ceases transferring said mechanical output to said first output transferring means and transfers said mechanical output to said second output transferring means;

an encounter indicating means located in said housing in operative association with said second output transferring means so as to receive said mechanical output from said second output transferring means and upon receipt of said mechanical output producing a discernable indication output;

switching means reset means located in said housing in operative association with said second output transferring means, said reset means in response to said switching means being in said second switching mode capable of actuating said switching means to switch said switching means from said second switching mode to said first switching mode to cease transferring said mechanical output to said second output transferring means and transfers said mechical output to said first output transferring means.

2. The toy of claim 1 wherein:

said object means is movably mounted in said housing and further including an object moving means;

said object moving means capable of moving said object in said housing.

3. The toy of claim 2 including:

timing means located in said housing in operative association with said mechanical output means, said timing means capable of controlling the length of time said mechanical output means produces said mechanical output.

4. The toy of claim 3 including:

register means operatively associated with said first output transferring means and capable of recording a parameter associated with the elapsed mechanical output transferred by the first output transferring means.

5. The toy of claim 4 including:

a motion complexing means interpositioned between said movable means and said first output transferring means, said complexing means capable of modifying the mechanical output transferred from said first output transferring means to said movable means;

said modification of said mechanical output being one of a modification of speed of movement and direction of movement.

6. The toy of claim 5 wherein:

said mechanical output transferred by said first output transferring means is a rotational mechanical output and said register means records a parameter related to the number of rotations transferred by said first output transferring means.

7. A toy which comprises:

a housing;

a motor located in said housing;

a motion transfer means operatively connected to said motor and capable of receiving motion from said motor and transferring said motion;

a carriage means movably mounted in said housing in operative association with said motion transfer means and movable linearly back and forth along an axis in response to motion received from said motion transfer means;

a control means located in said housing, at least a portion of said control means being mounted on said carriage means with said portion being movable in conjunction with said movement of said carriage means, said control means operatively associated with both said motion transfer means and said carriage means;

an object means movably mounted in said housing in association with said carriage means;

object moving means mounted on said housing and having a portion exposed out of said housing in a position so as to be capable of being manipulated by an operator of said toy, said object moving means operatively associated with said object means and capable of moving said object linearly back and forth along an axis which is parallel with the axis of movement of said carriage means;

said object means capable of interacting with said portion of said control means located on said carriage means if the movement of said object means under the influence of said manipulation of said operator is not coordinated with the movement of said carriage means in response to motion received by said carriage means from said motion transfer means and in response to said interaction of said object means with said control means disrupting said association of said motion transfer means and said carriage means stopping said movement of said carriage means.

8. The toy of claim 7 including:

detection means operatively associated with said control means and capable of detecting said disruption of said association of said carriage means and said motion transfer means and in response to said detection said control means initiating reinstatement of said association of said carriage means and said motion transfer means.

9. The toy of claim 8 wherein:

said detection means includes indicator means capable of indicating said disruption of said association between said carriage means and said motion transfer means.

10. The toy of claim 9 wherein:

said control means includes a reset means operatively associated with said detection means, said reset means activated upon initiation of said disruption and after the expiration of a predetemined event period said reset means initiating said reinstatement of said association between said carriage means and said motion transfer means.

11. The toy of claim 8 including:

a visual effects modifying means located in said housing in operative association with said carriage means and said object means, at least a portion of at least one of said carriage means and said object means being indirectly visible to the operator of said toy after interaction with said visual effects modifying means.

12. The toy of claim 11 wherein:

said detection means includes indicator means capable of indicating said disruption of said association between said carriage means and said motion transfer means.

13. The toy of claim 12 wherein:

said control means includes a reset means operatively associated with said detection means, said reset means activated upon initiation of said disruption and after the expiration of a predetermined event period said reset means initiating said reinstatement of said association between said carriage means and said motion transfer means.

14. The toy of claim 13 wherein:

said visual effects modifying means is movably mounted in said housing in association with said carriage means so as to move in conjunction with said carriage means, the movement of said visual effects modifying means increasing the complexity of the visual effects observed by said operator of said toy of said portion of said carriage means or said object means which has interacted with said visual effects modifying means.

15. The toy of claim 14 wherein:

said visual effects modifying means comprises a mirror capable of reflecting said portion of said object means or said carriage means;

at least one of said carriage means and said object means includes an illuminating means capable of illuminating a section of one of said carriage means or said object means with respect to its ambient environment.

16. The toy of claim 7 wherein:

said control means includes a sensing means, said sensing means including a first trip means and a second trip means each located on said carriage means in positions capable of being acted upon by said object means in response to lack of corrdination between the movement of said object means and said carriage means and in response to said lack of coordination said object means contacting said one of said trip means to initiate said disruption of said association of said motion transfer means and said carriage means.

17. The toy of claim 16 wherein:

said motor produces a rotary motion;

said motion transfer means includes a motion propagation means and a motion translation means, said motion propagation means capable of propagating said rotary motion from said motor to said motion translation means, said motion translation means capable of translating said rotary motion propagated to it and converting said rotary motion into linear motion and further transferring said linear motion to said carriage means to move said carriage means in its back and forth linear motion along its axis of motion.

18. The toy of claim 17 wherein:

said control means includes a switch means operatively associated with both of said sensing means and said propagation means, said switch means capable of disrupting said propagation of motion by said propagation means in response to said object contacting one of said trip means.

19. The toy of claim 18 including:

detection means operatively associated with said control means and capable of detecting said disruption of said association of said carriage means and said motion transfer means and in response to said detection, said control means initiating reinstatement of said association of said carriage means and said motion transfer means;

said detection means includes indicator means capable of indicating said disruption of said association between said carriage means and said motion transfer means;

said control means includes a reset means operatively associated with said detection means, said reset means activated upon initiation of said disruption and after the expiration of a predetermined event period said reset means initiating said reinstatement of said association between said carriage means and said motion transfer means.

20. The toy of claim 19 wherein:

said reset means is operatively associated with said switch means and in response to said reset means said switch means re-establishing said propagation of motion by said propagation means.

21. The toy of claim 20 wherein:

said propagation means includes motion variation means, said motion variation means capable of introducing variations of at least two types into said rotary motion propagated to said translation means.

22. The toy of claim 21 wherein:

said variations include variations in the speed and direction of said rotary motion.

23. The toy of claim 22 wherein:

said propagation means includes gear train means capable of propagating said rotary motion;

said variation means includes transmission means operatively associated with said gear train means;

said transmission means capable of varying both the speed and the direction of said rotary motion propagated by said gear train means.

24. The toy of claim 23 including:

a secondary carriage means located in said carriage means and a second translation means in operative association with said gear train means and said secondary carriage means, said second translation means receiving rotary motion from said gear train means and moving said secondary carriage means on said carriage means in response to receipt of said motion.

25. The toy of claim 24 wherein:

said first and said second trip means are located on said secondary carriage means.

26. The toy of claim 7 including:

a visual effects modifying means located in said housing in operative association with said carriage means and said object means, at least a portion of at least on of said carriage means and said object means indirectly visible to the operator of said toy after interaction with said visual effects modifying means.

27. The toy of claim 26 wherein:

said visual effects modifying means is movably mounted in said housing in association with said carriage means so as to move in conjunction with said carriage means, the movement of said visual effects modifying means increasing the complexity of the visual effects observed by said operator of said toy of said portion of said carriage means or said object means which has interacted with said visual effects modifying means.

28. The toy of claim 27 wherein:

said visual effects modifying means comprises a mirror capable of reflecting said portion of said object means or said carriage means.

29. The toy of claim 28 wherein:

at least one of said carriage means and said object means includes an illuminating means capable of illuminating a section of its ambient environment.

30. The toy of claim 29 wherein:

said illuminating means comprises an electrically stimulated light emitting device.

31. The toy of claim 30 wherein:

said mirror is capable of reflecting said illuminated section of said carriage means or said object means.

32. The toy of claim 31 wherein:

said mirror is convex in shape.

33. A toy which comprises:

a housing;

a motor located in said housing;

a moving means located in said housing and operatively connected to said motor, said moving means moved within said housing by said motor;

an object means movably mounted on said housing;

an object moving means mounted on said housing and having a portion exposed out of said housing in a position so as to be capable of being manipulated by an operator of said toy, said object moving means operatively associated with said object means and capable of moving said object means within said housing;

a visual effects modifying means located in said housing in operative association with both said moving means and said object means, said object means and said moving means indirectly visible to the operator of said toy after interaction with said visual effects modifying means.

34. The toy of claim 33 wherein:

said moving means comprises a carriage in said housing so as to be movable linearly back and forth along an axis;

a sensing means located in said housing.

* * * * *

UNITED STATES PATENT AND TRADEMARK OFFICE

CERTIFICATE OF CORRECTION

PATENT NO. : 4,474,372

DATED : OCTOBER 2, 1984

INVENTOR(S) : HIDEYASU KARASAWA

It is certified that error appears in the above-identified patent and that said Letters Patent is hereby corrected as shown below:

Column 4, line 64/65, "illustarte" should read --illustrate--.

Column 6, line 33,34, "negotiated" should read --negotiates--.

Column 9, line 18, "baffle 112" should read --baffle 122--.

Column 11, line 23, "tht" should read --that--.

Column 12, line 23, "gear" should read --gears--.

Column 12, line 24, "104" should read --194--.

Column 15, line 24, "gear" should read --gears--.

Column 15, line 35, "rotated" should read --rotates--.

Column 17, line 41, "292" should read --294--.

Column 17, line 45, "196" should read --296--.

UNITED STATES PATENT AND TRADEMARK OFFICE

CERTIFICATE OF CORRECTION

PATENT NO. : 4,474,372

DATED : OCTOBER 2, 1984

INVENTOR(S) : HIDEYASU KARASAWA

It is certified that error appears in the above-identified patent and that said Letters Patent is hereby corrected as shown below:

Column 18, line 54, "314" should read --214--.

Column 18, line 57, "314" should read --214--.

Column 19, line 41, "intermeshes" should read --intermeshed--

Column 19, line 67, "88" should read --288--.

Column 20, line 1, "88" should read --288--.

Column 21, line 24, "space" should read --surface--.

Column 21, line 45, "46" should read --406--.

Column 22, line 48, "a" should read --as--.

Column 27, line 25, "526" should read --536--.

Column 27, line 50, "when it lowered" should read --when it is lowered--.

Column 32, line 38/39, "corrdination" should read --coordination--.

Column 33, line 54, "on" should read --one--.

Signed and Sealed this

*Twenty-third* Day of *April 1985*

[SEAL]

*Attest:*

DONALD J. QUIGG

*Attesting Officer* *Acting Commissioner of Patents and Trademarks*